US005554479A

United States Patent [19]

Ochiai et al.

[11] Patent Number: 5,554,479

[45] Date of Patent: Sep. 10, 1996

[54] IMAGE FORMATION METHOD

[75] Inventors: Masahisa Ochiai, Fukaya; Masumi Asanae, Kumagaya, both of Japan

[73] Assignee: Hitachi Metals, Ltd., Tokyo, Japan

[21] Appl. No.: 356,064

[22] Filed: Dec. 14, 1994

[30] Foreign Application Priority Data

| | | | |
|---|---|---|---|
| Dec. 17, 1993 | [JP] | Japan | 5-343968 |
| Dec. 24, 1993 | [JP] | Japan | 5-347845 |
| Dec. 27, 1993 | [JP] | Japan | 5-348829 |
| Jan. 25, 1994 | [JP] | Japan | 6-006124 |

[51] Int. Cl.[6] ..... G03G 13/09; G03G 15/09

[52] U.S. Cl. ..... 430/122; 430/103; 355/251

[58] Field of Search ..... 430/122, 103; 355/251

[56] References Cited

U.S. PATENT DOCUMENTS

| | | | |
|---|---|---|---|
| 4,292,387 | 9/1981 | Kanbe et al. | 430/102 |
| 4,342,822 | 8/1982 | Hosono et al. | 430/122 |
| 4,565,765 | 1/1986 | Knapp et al. | 430/122 |
| 5,376,492 | 12/1994 | Stelter et al. | 430/122 |

FOREIGN PATENT DOCUMENTS

| | | |
|---|---|---|
| 57-9065 | 2/1982 | Japan . |
| 58-32377 | 7/1983 | Japan . |
| 62-201463 | 9/1987 | Japan . |
| 63-788 | 1/1988 | Japan . |
| 63-35984 | 7/1988 | Japan . |
| 63-223675 | 9/1988 | Japan . |
| 2150465 | 7/1985 | United Kingdom . |
| 2089244 | 6/1992 | United Kingdom . |

*Primary Examiner*—Richard L. Schilling
*Attorney, Agent, or Firm*—Staas & Halsey

[57] ABSTRACT

An image forming method for conveying a magnetic developer 70 held on the surface of a developer conveying member 40 opposed to a image-bearing member 30 to a developing region to develops electrostatic latent images, comprises implementing as the developer conveying member 40 a semiconductive or an insulating cylindrical magnet with a plurality of heteropolar magnet poles arranged alternatively on its surface, the overall magnet being integrally formed, rotating the developer conveying member 40 to convey the magnetic developer 70 to the developing region, and using the magnetic developer 70 conveyed to the developing region to develop electrostatic bearing member latent images formed on the image-bearing member 30.

This constitution allows an inexpensive sleeveless roll magnet to be used to obtain high-quality images.

17 Claims, 6 Drawing Sheets

IMAGE FORMATION METHOD

BACKGROUND OF THE INVENTION

1. Field of the Invention

The present invention relates to an image forming method using a developing device employing a roll magnet having no sleeve on its outer peripheral as a developer conveying member.

2. Description of the Prior Art

Conventionally known image forming devices include copying machines, printers, and facsimile terminal equipment. Among these devices, those using an electrophotograhic or electrostatic recording method generally supply a developer from developer conveying member provided in proximity to a image-bearing member to deposite the toner in the developer onto electrostatic latent images formed on the surface of the image-bearing member by means of light exposure to form image.

The image-bearing member and the developer conveying member are opposed at a specified gap. The main part of the developer conveying member mainly comprises a roll-like magnet for conveying a developer which has on its outer perifheral a sleeve made of a non-magnetic material (hereinafter referred to as a roll magnet), a magnetic brush regulating member for regulating the developer held on the surface of the sleeve to a specified layer thickness (hereinafter referred to as a doctor blade).

The roll magnet comprises a roll-like magnet provided in a developer hopper for storing the developer and having a plurality of magnetic poles on its surface and a sleeve covering the surface of the magnet so that the sleeve can rotate relative to the magnet. The roll magnet and the image-bearing member on which electrostatic latent images are to be formed are opposed to each other at a small specified gap.

While attracted to and retained on the surface of the sleeve, the developer passes through the very small gap between the surface of the sleeve and the doctor blade, when it is formed as a thin layer. The developer is then conveyed to the developing region where the roll magnet and the image-bearing member are opposed.

In response to an increased number of requirements, efforts are being made to improve image quality and to reduce the cost and size of image forming devices. Under these circumstances, a variety of proposals has been presented as candidates for a developing device that is the main component of the image forming device. For example, the use of a sleeveless type roll magnet but without the sleeve for retaining the developer around a magnet to develop electrostatic latent images has been proposed (for example, GB2150465A, PUPA 63-223675, and PUPA 62-201463). Developing devices using such a sleeveless type roll magnet usually use a single-component developer (magnetic toner) because it reduces the size of these devices and eliminates the need for maintenance.

However, methods using a sleeveless type roll magnet and a single-component developer do not apply a sufficient amount of charge to the toner constituting the developer, resulting in poor image quality. The doctor blade is thus pressed against the surface of the roll magnet to pass toner particles between the roll magnet and the doctor blade pressed against it, thereby causing triboelectric charge to the toner, This also enables toner retained on the surface of the roll magnet to become a thin layer.

Even if the doctor blade is pressed against the surface of the roll magnet, however, a sufficient amount of toner not be attracted on the surface of the sleeveless type roll magnet if a small amount of triboelectric charge is applied to the toner. To resolve this problem, fine electrodes have been proposed to be provided on the surface of the sleeveless type roll magnet attract toner (see GB2150465A).

This structure requires, however, that new fine electrodes be provided on the surface of the roll magnet, which fails to achieve the initial object of removing the sleeve to simplify the structure of the roll magnet and thereby to reduce the cost and size of the device.

On the one hand, a bias voltage (including a ground) must be applied to the developer to prevent fogging and to obtain reverse images in the developing region. To do this, the application of conductivity at least to the surface of the roll magnet has been proposed (see PUPA 62-201463 referenced above). Although this structure reduces cost, however, it still remains to be improved because the manufacture of such a roll magnet takes time.

On the other hand, the magnetic brush method is likely to cause fogging because a magnetic brush comprising a magnetic developer slides contact not only the image area forming electrostatic latent images but also the nonimage area.

A developing method based on jumping developing has thus become known; in this method, the layer of magnetic developer having a thickness less than the gap between the surface of the image-bearing member and the surface of the sleeve in the developing region is used to convey toner in a magnetic developer to electrostatic latent images (for example, see U.S. Pat. No. 4,292,387 or U.S. Pat. No. 4,342,822). In this jumping developing method, an AC bias voltage applied in the developing region to improve the reproductivity (gradient) of half-tones.

FIG. 5 is a transverse cross section of the important part of the prior art showing an example of the jumping developing method. In this figure, reference numeral 1 designates the developer vessel 1 accommodating the magnetic developer 2. Provided below the magnetic developer is a developing roller 6 comprising a permanent magnet member 4 comprising a plurality of permanent magnets 3 and shaped in the form of a cylinder and a sleeve 5 made of a non-magnetic metal material such as a austenic stainless steel (for example, SUS304) in such a way that the permanent magnet member and the sleeve are coaxial and rotatable relative to each other.

Reference numeral 7 is a drum having a photosensitive (photosemiconduction) layer on its surface formed so as to rotate in the direction of the arrow and opposed to the developing roller 6 with a gap (g) in between. Reference numeral 8 is a doctor blade provided on the developer vessel 1 and opposed to the developing roller 6 with a gap (t) in between for regulating the thickness of the layer of magnetic developer attracted onto the sleeve 5 constituting the developing roller 6. Reference numeral 9 is an AC power supply connected between the photosensitive drum 7 and the doctor blade 8 to apply an AC bias voltage. The gap (g) is set to be greater than the thickness of the layer of the magnetic developer on the sleeve 5.

With the above structure, when the permanent magnet member 4 is fixed and the sleeve 5 is rotated in the direction of the arrow, the magnetic developer 2 is attracted to the sleeve 5 and then conveyed. The developer arrives in the developing region opposite to the photosensitive drum 7, where the electric fields of electrostatic latent images formed on the photosensitive drum 7 cause the magnetic developer 2 to overcome the attractive force of the permanent magnet member 4 to sleeve 5 to move onto the drum 7. This enables electrostatic latent images to be developed.

In the jumping developing method described above, the thickness of the layer of magnetic developer 2 on the sleeve 5 is generally less than 0.2 to 0.4 mm as is common with ordinary magnetic brush developing methods, for example, about 0.1 mm. The roundness of sleev 5 and concentricity of the outer circumferential surface of the permanent magnet member 4 and sleeve 5 must be improved to perform highly accurate machining.

The outer circumferential surface of the sleeve 5 attracts the magnetic developer 2 using the magnetic attractive force of the permanent magnet member 4, and conveys it using frictional force. To improve conveying abikity, for example, blasting is usually performed to make the roughened surface of the sleeve. However, since friction progresses during operation to change the coefficient of friction or to cause other local changes, the thickness of the layer of magnetic developer 2 that is attracted is changed in such a way as to adversely affect developing. A slight temporal change in the conditions of the surface of the sleeve 5 severely and adversely affects developing because the thickness of the layer of the magnetic developer on the sleeve 5 is small in the jumping developing method as described above.

Methods for using the magnetic brush method to develop electrostatic latent images by removing the sleeve 5 constituting the developing roller 6 and using the permanent magnet member 4 alone have also been proposed to miniaturize printers as described above (for example, see PUPA 62-201463). In these methods, about half the height of the magnetic brush comprising the magnetic developer contacts the surface of the photosensitive drum 7

In this form of magnetic brush method, however, the insufficient accuracy of the permanent magnet member 4 causes deflection resulting in nonuniform images. Thus, when the gap between the surface of the photosensitive drum 7 and the surface of the permanent magnet member 4 in the developing region, that is, the developing gap is widened, the gap between the surface of the doctor blade 8 and the surface of the permanent magnet member 4, that is, the doctor blade gap, must be widened accordingly. However, a large doctor blade gap prevents sufficient triboelectric charge from being applied to the toner in the magnetic developer 2, thereby causing frequent fogging.

SUMMARY OF THE INVENTION

It is thus the object of a first invention to provide an image forming method for using an inexpensive sleeveless type roll magnet to obtain high-quality images.

It is the object of a second invention to provide an image forming method for using an inexpensive conductive sleeveless roll magnet to obtain high-quality images.

It is the object of a third invention to provide an image forming method for employing a jumping developing method wherein an image forming device can be miniaturized and high-quality images can be formed even if the developing gap is large.

It is the object of a fourth invention to provide an image forming method for using an inexpensive sleeveless type roll magnet to obtain high-quality images even with a single-component developer.

To achieve the above objects, in an image forming method for conveying a magnetic developer held on the surface of a developer conveying member opposed to a image-bearing member to a developing region to develop electrostatic latent images, the first invention:

implements as the developer conveying member a semiconductive or an insulating cylindrical magnet with a plurality of heteropolar magnetic poles arranged alternatively on its surface, the overall magnet being integrally formed;

uses as the magnetic developer a two-component developer containing a magnetic carrier and toner;

rotates the developer conveying member to conveying the magnetic developer to the developing region; and uses the magnetic developer conveyed to the developing region to visualize electrostatic latent images formed on the image-bearing member.

The magnetic carrier has an average particle size of 10 to 150 μm and a magnetization of 50 emu/g or more in a magnetic field of 1,000 Oe. The toner is magnetic and the developer has a toner concentration of 10 to 90 wt. %.

In addition, the magnetic carrier has an average particle size of 5 to 100 μm and a magnetization of 50 emu/g or more in a magnetic field of 1,000 Oe. The toner is non-magnetic and the developer has a toner concentration of 5 to 60 wt. %.

If the peripheral speed of the image-bearing member, and the outer diameter, the number of magnetic poles, and the peripheral speed of the developer conveying member are represented as Vp (mm/s), D (mm), M, and Vm (mm/s), respectively, h (mm) that can be expressed as $\pi D.Vp/M.Vm$ has a value of 2 or less. The developer conveying member has a magnetic flux density (Bo) of 50 to 1,200 G.

A regulating member for regulating the thickness of the developer loyer is provided in the developer conveying member, and a developing bias voltage that is a superimposition of an AC bias voltage on a DC bias voltage is applied to this regulating member.

The first invention can reduce the cost of the device because the usual cylindrical ferrite or resin bonded magnet can be used without any modifications because a semiconductive or an insulating cylindrical permanent magnet with magnet poles with different polarities provided alternatively is used as the developer conveying member.

Since the first invention employs a two-component developer comprising a carrier and toner, it can cause triboelectric charge between the carrier and toner to eliminate the common disadvantage of the prior art involved in the use a magnet without a sleeve, that is, a sleeveless type roll magnet as developer conveying member wherein a sufficient amount of charges is not applied to the toner.

In particular, the use of a carrier with a magnetization of 50 emu/g or more as measured in a magnetic field of 1,000 Oe provides accurate images and prevents the adhesion of itself even if it has small average particle size, for example, 10 to 50 μm.

In an image forming method for conveying the magnetic developer held on the surface of a developer conveying member opposed to a image-bearing member to a developing region to develop electrostatic latent images, the second invention:

implements as the developer conveying member a cylindrical magnet with a plurality of heteropolar magnetic poles located alternately on its surface and having a volume resistivity of $10^6$ Ω.cm at least on its surface, the overall magnet being integrally formed, uses as the magnetic developer a two-component developer containing a magnetic carrier and toner, applies to the developing region a developing bias voltage that is a superimposition of an AC bias voltage on a DC bias voltage, and rotates the developer conveying member to convey the magnetic developer to the developing region, where the developer is used to develop electrostatic latent images formed on the surface of the image-bearing member.

The magnetic carrier has an average particle size of 10 to 100 μm as well as a nonspherical form. The amount of the magnetic toner in the developer (a toner concentration) is 10 to 90 wt. %.

In addition, the magnetic carrier has an average particle size of 10 to 100 μm as well as a nonspherical form. The toner is non-magnetic and a toner concentration is 5 to 60 wt. %.

If the peripheral speed of the image-bearing member, and the outer diameter, the number of magnetic poles, and the peripheral speed of the developer conveying member are represented as Vp (mm/s), D (mm), M, and Vm (mm/s), respectively, h (mm) that can be expressed as $\pi D.Vp/M.Vm$ has a value of 2 or less. The developer conveying member has a magnetic flux density (Bo) of 50 to 1,200 G.

A regulating member for regulating the thickness of the developer layer is provided in the developer conveying member, and a developing bias voltage that is a superimposition of an AC bias voltage on a DC bias voltage is applied to this regulating member.

The second invention can reduce the cost of the device because the usual cylindrical ferrite or resin bonded magnet can be used simply by applying conductivity at least to its surface because a conductive cylindrical permanent magnet with magnetic poles with different polarities provided alternatively which has a volume resistivity of $10^6$ Ω.cm or less is used as the developer conveying member. A DC bias voltage is applied to the developer and also effectively superimposes an AC bias voltage because the surface of the roll magnet has a conductivity of $10^6$ Ω.cm or less.

Since the second invention employs a two-component developer comprising a carrier and toner, it can cause triboelectric charge between the carrier and toner to eliminate the common disadvantage of the prior art involved in the use of a magnet without a sleeve, that is, a sleeveless roll magnet as a developer conveying member wherein a sufficient amount of charge is not applied to the toner.

In particular, the use of a nonspherical carrier with an average particle size of 10 to 100 μm provides accurate images and prevents the adhesion of the carrier, In addition, since this invention applies an AC bias voltage superimposed on a DC bias voltage to developer, the developer is prohibited from agglomerating when charged, thereby improving the transportability of the developer and preventing fogging.

In an image forming method for conveying a magnetic developer held on the surface of a developer conveying member opposed to a image-bearing member to a developing region to visualize electrostatic latent images, the third invention:

implements as the developer conveying member a semiconductive or an insulating cylindrical magnet with a plurality of heteropolar magnetic poles located alternatively on its surface, the overall magnet being integrally formed, uses as the magnetic developer containing an insulating toner, sets the width of the gap between the image-bearing member and the developer conveying member larger than the thickness of the layer of the magnetic developer, applies to the developing region a developing bias voltage that is the superimposition of an AC bias voltage on a DC bias voltage, and rotates the developer conveying member to convey the magnetic developer to the developing region, where the developer is used to develop electrostatic latent images formed on the surface of the image-bearing member.

The magnetic developer is a two-component developer comprising a carrier having an average particle size of 10 to 150 μm and a magnetization of 50 emu/g a magnetic field of 1,000 Oe and or more in magnetic toner the amount of the magnetic toner in the developer (toner concentration) being 10 to 90 wt. %.

In addition, the magnetic developer is a two-component developer comprising a carrier having an average particle size of 10 to 150 μm and a magnetization of 50 emu/g or more in a magnetic field of 1,000 Oe and non-magnetic toner having a toner concentration of 5 to 60 wt. %.

In addition, the magnetic developer is a single-component developer comprising a magnetic toner.

If the peripheral speed of the image-bearing member, and the outer diameter, the number of magnetic poles, and the peripheral speed of the developer conveying member are represented as Vp (mm/s), D (mm), M, and Vm (mm/s), respectively, h (mm) that can be expressed as $\pi D.Vp/M.Vm$ has a value of 2 or less. The developer conveying member has magnetic flux density (Bo) of 50 to 1,200 G.

The third invention can provide high-quality images without fogging even if the device uses a small developer support means without a sleeve as well as a relatively wide developing gap specific to the jumping developing.

In the image forming method for conveying a magnetic developer held on the surface of a developer conveying member opposed to a image-bearing member to a developing region to develop electrostatic latent images, the fourth invention:

contacts the developer conveying member with a regulating member for regulating the thickness of the layer of toner, implements as the developer conveying member a cylindrical magnet with a plurality of heteropolar magnetic poles located alternatively on its surface, the overall magnet being integrally formed, uses as the magnetic developer a single-component developer containing magnetic toner, applies to the developing region a developing bias voltage that is a superimposition of an AC bias voltage on a DC bias voltage, and rotates the developing conveying member to convey the magnetic developer to the developing region, where the developer is used to develop electrostatic latent images formed on the surface of the image-bearing member.

If the peripheral speed of the image-bearing member, and the outer diameter, the number of magnetic poles, and the peripheral speed of the developer conveying member are represented as Vp (mm/s), D (mm), M, and Vm (mm/s), respectively, h (mm) that can be expressed as $\pi D.Vp/M.Vm$ has a value of 2 or less. The developer conveying member has magnetic flux density (Bo) of 50 to 1,200 G.

The fourth invention can reduce the cost of the device because the usual cylindrical ferrite or resin bonded magnet can be used without any modifications because a cylindrical permanent magnet with magnetic poles with different polarities provided alternatively is used as the developer conveying member.

Furthermore, the fourth invention can use triboelectric charge to apply a sufficient amount of charge to the toner because the toner brush regulation member for regulating the thickness of the layer of the developer on the surface of the developer conveying member contacts that surface. This invention also provides a thin uniform layer of magnetic toner compared to the toner brush regulating member and the developer conveying member that are opposed at a certain gap.

Since the fourth invention applies not only an DC bias voltage but also an AC bias voltage superimposed on it, toner adhering to the non-image area (charged portion in reverse development) of the electrostatic latent image can be returned easily to the developer conveying member, thereby preventing fogging. Moreover, the adjustment of the pitch between the magnetic poles opposing to the image-bearing member per a unit of time to 2 mm or less to further facilitate the conveying ability of the toner that is already improved by application of an AC bias voltage superimposed on a DC bias voltage, thereby further enhancing the prevention of fogging.

DETAILED DESCRIPTION OF THE PREFERRED EMBODIMENTS

Embodiment 1

Figure 1:
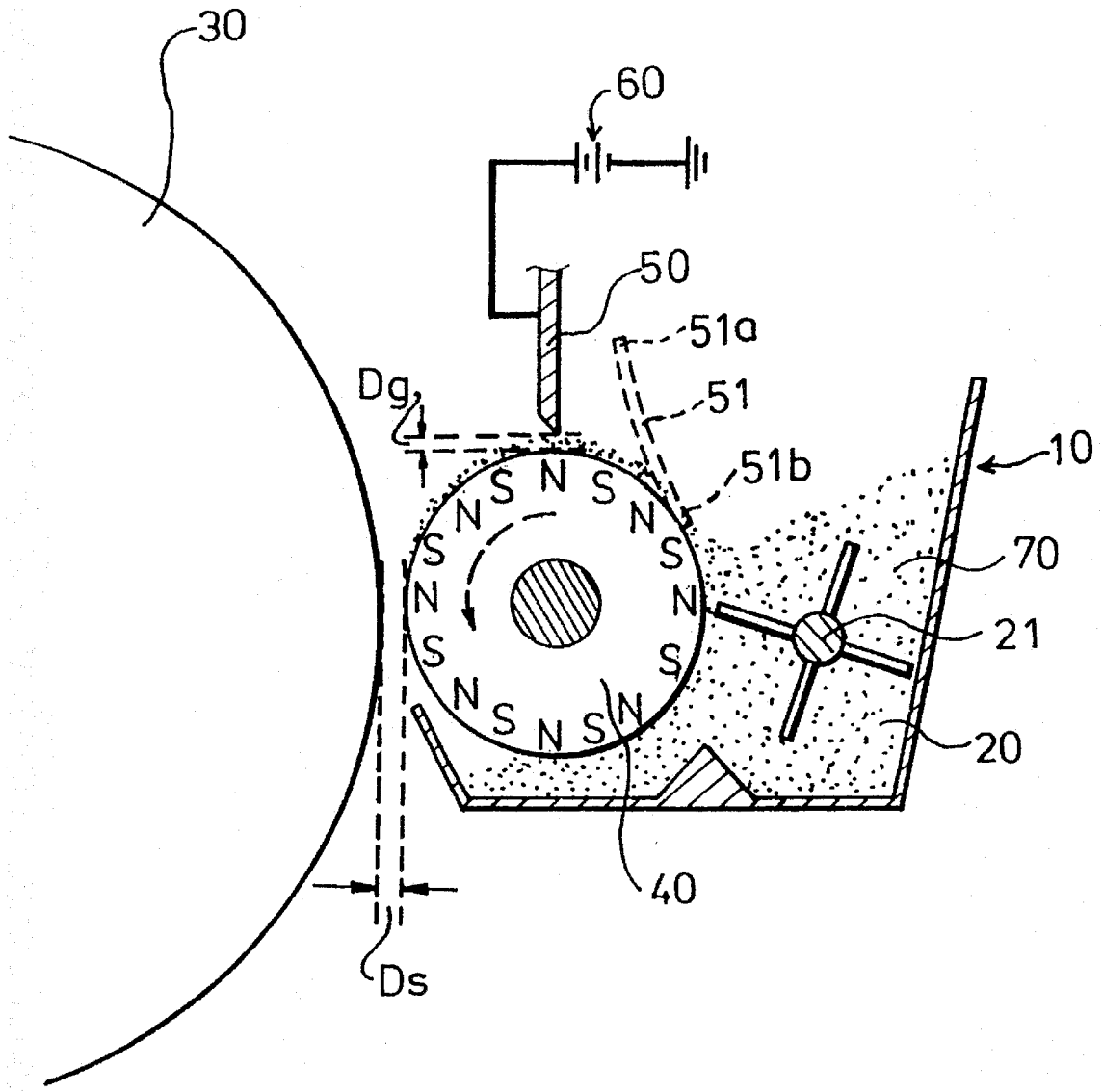
FIG. 1 is a typical view of the main part of an image forming device for implementing the first invention.

FIG. 1 is a typical view of the main part of an image forming device for implementing the first embodiment. In this figure, a developing device 10 has in a developer hopper 20 for storing a developer 70, a rotatable cylindrical sleeveless roll magnet 40 opposed at a very small gap Ds (developing gap) from the surface of a photosensitive drum 30 that rotates at a constant revolution.

Furthermore, the sleeveless roll magnet 40 has a toner brush regulating plate (hereinafter referred to as a doctor blade) 50 opposed at a very small gap Dg (doctor blade gap) from the surface of the sleeveless roll magnet 40. The doctor blade 50 is further connected to a bias voltage supply 60 for applying a bias voltage.

After electrostatic latent images are developed, some of the remaining developer on the surface of the sleeveless roll magnet 40 can be released by the back of the doctor blade 50 and replaced with new developer. However, a scraping blade (not shown) may be added when needed.

A stirring roller 21 for stirring the developer is provided in the developer hopper 20, and a charger for uniformly charging the surface of the photosensitive drum 30 and a light exposure device for forming electrostatic latent images (not shown) are provided around the photosensitive drum 30.

The magnet constituting the developer conveying member is magnetized so that N and S poles are arranged alternatively on its surface, and may be a sintered magnet (for example, a ferrite magnet) or a resin bonded magnet (a plastic or a rubber magnet). The magnet may be the above magnet formed on a shaft like a roller or may be formed of a magnet material integrally with the shaft.

However, this permanent magnet should be integrally formed in its entirety (including no joints) so as to prevent nonuniform developing.

On the one hand, in a developing device using a roll magnet, the magnetic flux density of the surface of the roll magnet decreases with the increase in the number of magnetic poles because heteropolar magnetic poles are arranged alternatively at a very small interval.

On the other hand, the magnetic flux density of the surface of the sleeveless roll magnet 40 should be 50 G or more so as to prevent the adhesion of the carrier to provide high image quality. In view of the above points, the number of poles in a magnet is preferably between 8 and 60, corresponding to the preferable range of the magnetic flux density (Bo) of the sleeveless roll magnet 40 of 50 to 1,200 G. A more preferable range of Bo is 100 to 800 G.

If magnetic poles are arranged at a very small pitch to increase the number of magnetic poles on the surface of the magnet, a small magnetic field will be formed around the magnet, thereby reducing the attraction of toner to the surface of the magnet and forming a nonuniform layer of toner on the surface of the magnet. To prevent this, the magnet should be rotated at a high speed.

However, too slow a rotation results in a nonuniform image density, while too fast a rotation results in an increase in noise or in the heating quantity during driving or wear of the carrier in response to a large rotational torque.

Consequently, the peripheral speed of the magnet is preferably set within a range of one to about ten times as high as that of the photosensitive drum. In particular, in the aspect of image quality, the speed is preferably set within a range of about two to six times as high as that of the photosensitive drum.

If the peripheral speed of a magnet and the outer diameter, the number of poles, and the peripheral speed of a roll magnet are represented as Vp (mm/s), D (mm), Vm M, and (mm/s), respectively, D, and V are preferably set in such a way that h (mm) in the equation below is less than 2.

$$h=\pi D.Vp/M.Vm(mm) \qquad \text{Equation 1}$$

The above (h) is the pitch of the magnetic poles opposed to the surface of the photosensitive drum within a unit of time. If this value exceeds 2 mm, developing will be nonuniform. That is, unevenness (shading) of image density generates through the moving direction of the photosensitive drum. The value of (h) is preferably 1 mm or less. To reduce (h), M and Vm may be increased. If the value of M is too large, however, the magnetic flux density of the surface of the roll magnet will be too low, and an increase in the value of Vm results in the above inconvenience. Consequently, (h) is preferably within a range of 0.4 to 1.0 mm in the aspect o f practicality. +P In addition, the doctor blade 50 may be located in contact with (pressed against) the surface of the magnet, or provided opposite to the surface of the magnet at a very small gap (also referred to as a "doctor blade gap" Dg). When the doctor blade 50 is provided, the relationship between Dg and the gap between the surface of the photosensitive drum 30 and the surface of the magnet (referred to as a "developing gap" Ds) preferably meets the condition Ds−Dg=0.2±0.15 (mm) to provide high image quality. +P If the doctor blade contacts the surface of the magnet, for example, one end 51*a* of an elastic blade 51 (designated by broken lines in the figure) formed of a magnetic material such as an SK steel [carbon tool steel (JIS G 44011] (or a non-magnetic material such as austenitic stainless steel (for example SUS304) or phosphor bronze) may be fixed to the developer hopper 20 and the tip portion of the elastic blade 51*b* may be pressed against the surface of the magnet. +P In addition, in the first invention, since the semiconductive or insulating sleeveless roll magnet 40 retains the magnetic developer 70 on its surface, the bias voltage is preferably applied from the doctor blade 50. In this case, the doctor blade 50 may be formed of a non-magnetic and conductive material (for example an aluminum alloy or brass). +P A DC bias voltage may be applied, or an alternating current (preferably a low-frequency alternating current less than 10 kHz) may be superimposed to reduce fogging. +P As described above, an ordinary two-component developer comprising a carrier and non-magnetic toner or a two-component developer comprising a carrier and magnetic toner may be used as the magnetic developer 70. +P To execute developing, a predetermined toner concentration of the developer may be fed into the developer hopper 20, or a carrier may be attached to the surface of the magnet before filling the developer hopper 20 with toner. This eliminates the need of a toner concentration control means and helps to reduce the size of the developing device 10. +P Appropriate carriers include those magnetic particles such as iron powder, soft ferrites, magnetites, or binder particles with magnetic powder distributed in a resin which have an average particle size of 10 to 150 μm and a magnetization of 50 emu/g as measured in a magnetic field of 1,000 Oe. Carriers are likely to adhere to the surface of the magnet if magnetization is less than 50 emu/g. +P If a ferrite or a magnetite is used, the ferrite or magnetite preferably has a magnetization of 55 to 80 emu/g (saturation magnetization: 65 to 95 emu/g) or 58 to 63 emu/g (saturation magnetization: 86 to 98 emu/g) as measured in a magnetic field of 1,000 Oe, respectively. +P Carriers, in particular, iron powder carriers preferably have a flat shape, instead of a spherical shape, which is usually used to obtain better effects. +P If the major axis and thickness of a carrier are represented as (a) and T, respectively, T/a 1 for a spherical carrier and T/a=0.02 to 0. 5 for nonsperical (flat (coin-shaped) or massive) carrier (preferably 0.03 to 0.5, or, more preferably, 0.05 to 0.5). If T/a<0.02, the carrier will have its fluidity reduced and be prevented from forming good magnetic brushes on the roll magnet, leading to nonuniform image density. If T/a>0.5, the carrier will be close to a sphere and prevented from applying a sufficient triboelectric charge to the toner. +P Furthermore, it is particularly preferable that the average particle size of a carrier be 10 to 50 μm because a sufficient amount of charge is applied to the toner when the average particle size is 50 μm or less while the carrier is likely to adhere to the surface of the photosensitive drum when the average particle size is less than 10 μm. +P In addition, in the first invention, more than one type of the above magnetic particles may be mixed. For example, large magnetic particles 60 to 120 μm in average particle size may be mixed with small magnetic particles 10 to 50 μm in average particle size, or binder type magnetic particles 10 to 50 μm in average particle size may be mixed with iron powder of the same average particle size. +P The mixing rate can be determined by considering the size and magnetic characteristics of the magnetic particles to be mixed. +P Either magnetic or non-magnetic toner can be used. However, in the aspect of transferability, the toner is preferably insulating (volume resistivity: $10^{14}$ Ω.cm or more) and easily charged when brought into contact with a carrier (the amount of triboelectric charge: 10 μC/g or more at absolute value). The concentration of toner is preferably within a range of 10 to 90 wt. % for magnetic toner, and 5 to 60 wt. % for non-magnetic toner. +P In addition, in the aspect of image quality, the magnetic toner preferably contains 20 to 70 wt. % of magnetic powder. The toner may otherwise scattere from the roll magnet if the content of the magnetic powder is too small, while the toner may not be easily fixed if the content of the magnetic powder is too large. +P Like ordinary toner, the toner in accordance with this invention contains a binder resin (for example a styrene-acrylic copolymer or a polyester resin) and a coloring agent (not required when a magnetite is used for the magnetic powder) as essential components and magnetic powder (for example a magnetite or a soft ferrite), a chare-controlling agent (for example nigrosine or an azo dye), a release agent (for example polyolefine), and a fluidity improwrs (for example hydrophobic silica) as optional components. +P Color toner (for example red, blue, or green) can be generated by selecting coloring agents as appropriate. +P The above magnetization was measured using a vibrating sample magnetometer (Model VSM-3 manufactured by Toei Industry Co., Ltd.). The average particle size of the toner was measured using a particle size analyzer (Coulter Counter Model TA-II manufactured by Coulter Electronics Inc.). +P The volume resistivity was measured by filling 10 or more mg of sample in a Teflon (trade name) cylinder 3.05 mm in inner diameter and then applying 100 g.f of load to the sample in the electric field of DC 4 kV/cm. The amount of the triboelectric charge was measured using commercially available triboelectric charge measuring equipment (model TB-200 manufactured by Toshiba Chemical Inc.) under a toner concentration of 5 wt. %, with a ferrite carrier (KBN-100 manufactured by Hitachi metals, Ltd.) as a standard carrier.

Experiment 1

The two-component developer used in this example of experiment comprises an iron powder carrier and magnetic toner.

To prepare an iron powder carrier, 100 pts.wt. of flat iron powder (MC-SI manufactured by Hitachi metals, Ltd.) was mixed in a mixer with 1 pts.wt. of silicone resin for covering the surface of the powder, and the mixture was then thermally treated in a circulating air furnace at 150 ° C. After cooling, the mixture was classified to obtain an iron powder carrier 50 μm in average particle size.

This iron powder carrier had a magnetization of 70 emu/g (saturation magnetization: 200 emu/g) in a magnetic field of 1,000 Oe.

To prepare a magnetic toner, 55 pts.wt. of styrene-n-butyl methacrylate copolymer (weight average molecular weight: $21\times10^4$; number average molecular weight: about $1.6\times10^4$) as a binder resin, pts.wt. of magnetite (EPT500 manufactured by Toda Kogyo Corporation) as the magnetic powder, 3 pts.wt. of polypropylene (TP32 manufactured by Sanyo chemical Co., Ltd.) as the release agent, and 2 pts.wt. of charge-controlling agent (Bontron S34 manufactured by Orient chemical Industries, Ltd.) were dry-mixed in a mixer. The mixture was then heated, kneaded, cooled, and solidified. It was then pulverized using a jet mill or a rotary stator crusher. The pulverized material was then classified to obtain a magnetic toner 10 μm in volume average particle size. This magnetic toner has a volume resistivity of $5\times10^{14}$ Ω.cm and a triboelectric chage of −15 μC/g.

The above iron powder carrier and magnetic toner were mixed so as to obtain a toner concentration of 50 wt. %, thereby preparing a two-component developer. This developer was used to evaluate image quality through reverse development.

The following experiments were performed under environmental conditions of a room temperature (20° C.) and a room humidity (relative humidity(R.H): 60%.)

The sleeveless roll magnet 40 used in this example was a roll magnet having a diameter of 20 mm and used for A4-sized paper wherein a cylindrical ferrite magnet was fixed to a metal shaft and 16 poles were located symmetrically. This roll magnet 40 has a surface magnetic flux density of 550 G and the unexposed area of the surface of the photosensitive drum (opc drum) 30 has a potential of −500 V.

A brass doctor blade 50 was used, and D.C. voltage of −450 V was applied to this doctor blade 50 for reverse development.

The developing gap Ds was set to 0.4 mm and the doctor blade gap Dg was set to 0.3 mm. Furthermore, the peripheral speed of the sleeveless roll magnet 40 (Vm) was set to be four times as high as that of the photosensitive drum 30 (Vp=25 mm/s). Under the above conditions, the effect of a two-component developer (with a toner concentration (Tc) of 50 wt. % in this experiment) on the image quality was compared with the effect of a single-component developer (with a toner concentration (Tc) of 100 wt. %) on image the quality using the sleeveless roll magnet 40. The results are shown in Table 1.

The final toner images were obtained by transferring the developed toner image on the photosensitive drum by corona transfer unit onto plain paper and then heat roller fixing (line pressure: 1 kg/cm; fixing temperature: 180° C.). Four items were evaluated: the image density, the fogging density, the spreadness of toner, and the uniformity of the width of thin lines.

TABLE 1

| example | 1 | 2 |
|---|---|---|
| toner concentration (wt %) | 50 | 100 (toner alone) |
| image density | 1.4 | 1.4 |
| absence of fogging | good | bad |
| absence of spreadness of toner | good | bad |
| uniformity of width of thin lines | good | bad |
| remarks | Vm = 4 × Vp | |

Table 1 shows that the 50 wt. % toner is equivalent to the 100 wt. % toner in terms of the image density but that the 50 wt. % exceeds the 100 wt. % in the fogging density, the spreadness of toner, and the uniformity of the width of thin lines. That is, a two-component developer with a toner concentration of 50 wt. % in this experiment can present a higher image quality than a single-component developer.

Figure 6:
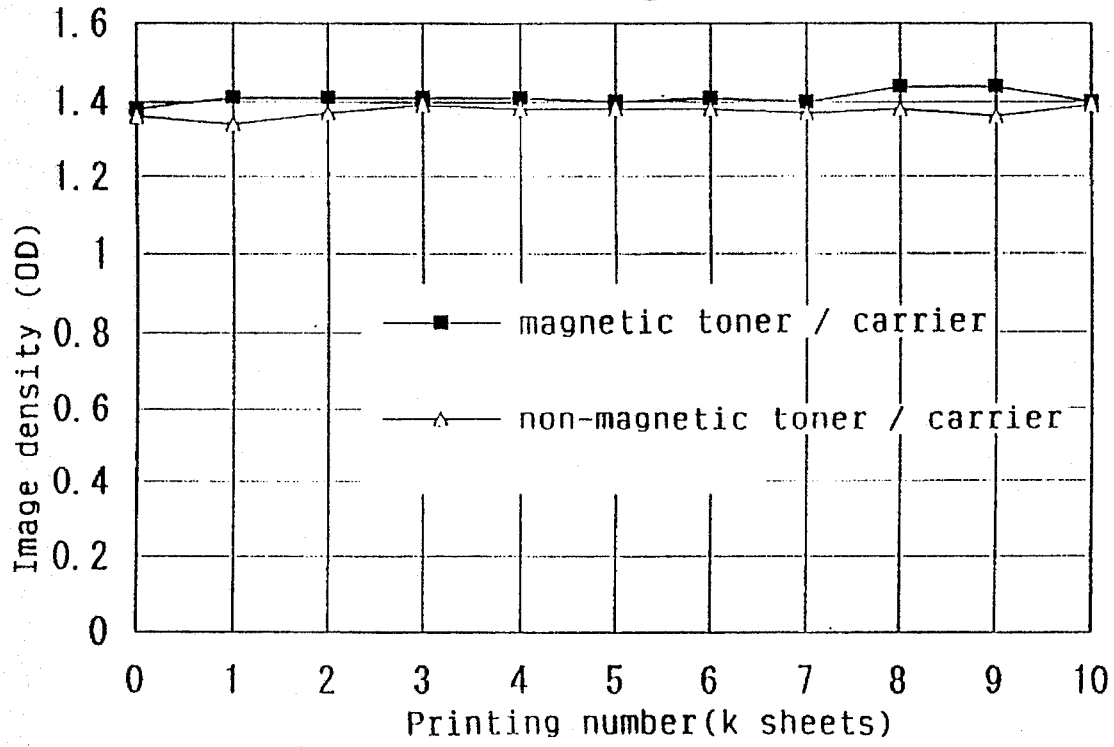
FIG. 6 is a result of consecutive printing tests, showing a relation between printing number and image concentration.

Furthermore, continuous printing tests for 10,000 sheets of papers were performed under the same conditions as the above except that the toner concentration was set to 45 wt. %. The result is shown in FIG. 6. FIG. 6 shows that a change of the image density is excessively small.

Figure 7:
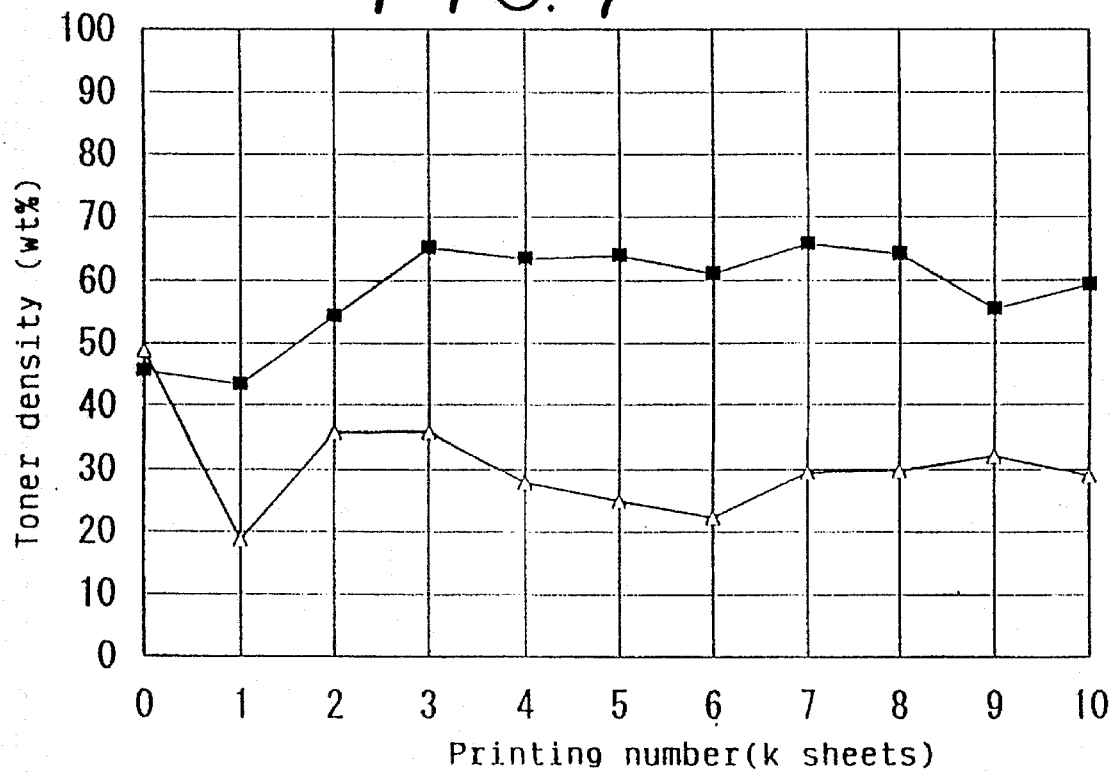
FIG. 7 is a result of consecutive printing tests, showing a relation between printing number and toner concentration.

In addition, as shown in FIG. 7, a change of the toner concentration is within the acceptable range. Moreover, although other image items were evaluated, it was confirmed that the almost same results as the initial images were obtained.

Experiment 2

Images were formed and evaluated under the same conditions as in experiment 1 except that four types of magnetic particles with different particle sizes and materials were used as the carrier. The results are shown in Table 2.

TABLE 2

| example | | 3 | 4 | 5 | 6 |
|---|---|---|---|---|---|
| carrier | material | iron powder | magnetite | Cu—Zn ferrite | Ba—Ni—Zn ferrite |
| | shape | flat | sphere | sphere | sphere |
| | average partide size (μm) | 60 | 80 | 100 | 120 |
| | $\delta_{1000}$ (emu/g) | 70 | 62 | 60 | 45 |
| image | image density | 1.39 | 1.37 | 1.31 | 1.28 |
| | absence of fogging | good | good | good | good |
| | absence of spreadness of toner | good | good | good | good |
| | uniformity of width of thin lines | good | good | good | good |

Table 2 shows that even a carrier with a large average particle size (60 to 120 μm) can produce high-quality images. The image density somewhat decreases, however, when the magnetization ($\sigma_{1000}$) of the carrier is low (experiment 6). In addition, a flat carrier produces images with a higher density.

Experiment 3

Images were formed and evaluated under the same conditions as in experiment 1 except that four types of magnetic particles with different particle sizes and materials were used as the carrier and that the developer with its toner concentration adjusted to 5 wt. % using the toner prepared as described below was used. The results are shown in Table 3.

85 pts.wt. of styrene-acrylic copolymer (the same as in experiment 1), 10 pts.wt. of carbon black (#50 manufactured by of polypropylene (TP32 manufactured by Sanyo chemical Co., Ltd.), and 2 pts.wt. of charge controlling agent (Bontron S34 manufactured by Orient chemical Industries, Ltd.) were processed in the same manner as in experiment 1 to prepare a toner with a volume average particle size of 10 μm (volume resistivity: $6\times10^{14}$ Ω.cm; triboelectric charge: −23 μC/g).

TABLE 3

| example | | 7 | 8 | 9 | 10 |
|---|---|---|---|---|---|
| carrier | material | iron powder | magnetite | Cu—Zn ferrite | Ba—Ni—Zn ferrite |
| | shape | flat | sphere | sphere | sphere |
| | average partide size (μm) | 5 | 10 | 25 | 40 |
| | $\delta_{1000}$ (emu/g) | 65 | 60 | 57 | 42 |
| image | image density | 1.41 | 1.41 | 1.35 | 1.35 |

TABLE 3-continued

| example | 7 | 8 | 9 | 10 |
|---|---|---|---|---|
| absence of fogging | good | good | good | good |
| absence of spreadness of toner | good | good | good | good |
| uniformity of width of thin lines | good | good | good | good |

Table 3 shows that a carrier with a smaller average particle size and a higher $\sigma_{1000}$ produces denser images.

Experiment 4

Images were formed and evaluated under the same conditions as in experiment 1 except that flat iron powder 25 μm in average particle size was used as the carrier and that five types of developers with different toner concentrations were used. The results are shown in Table 4.

TABLE 4

| example | 11 | 12 | 13 | 14 | 15 |
|---|---|---|---|---|---|
| toner concentration (wt %) | 5 | 10 | 25 | 65 | 90 |
| image density | 1.27 | 1.33 | 1.35 | 1.37 | 1.40 |
| absence of fogging | good | good | good | good | common |
| absence of spreadness of toner | good | good | good | good | good |
| uniformity of width of thin lines | good | good | good | good | good |

Table 4 shows that high-quality images are obtained when the toner concentration is within a range of 5 to 90 wt. % if a developer comprising a mixture of a magnetic carrier and magnetic toner used. However, the image density decreases when the toner concentration is less than 10 wt. %, and fogging is likely to occur when the toner concentration is 90 wt. %.

Experiment 5

Images were formed and evaluated under the same conditions as in experiment 3 except that flat iron powder 25 μm in average particle size was used as a carrier and that four types of developers with different toner concentrations were used.

TABLE 5

| example | 16 | 17 | 18 | 19 |
|---|---|---|---|---|
| toner concentration (wt %) | 3 | 10 | 30 | 60 |
| image density | 1.25 | 1.37 | 1.39 | 1.42 |
| absence of fogging | good | good | good | common |
| absence of spreadness of toner | good | good | good | common |
| uniformity of width of thin lines | common | good | good | good |

Table 5 shows that high-quality images are obtained when the toner concentration is within a range of 3 to 60 wt. % if a developer comprising a mixture of a magnetic carrier and non-magnetic toner is used. However, the width of thin lines is non-uniform when the toner concentration is low, and more fogging and spreadness of toner occur when the toner concentration is high.

Furthermore, continuous printing tests for 10,000 sheets of papers were performed under the same conditions as the above except that the toner concentration was set to 50 wt. %. The result is shown in FIG. 6. FIG. 6 shows that a change of the image density is excessively small.

In addition, as shown in FIG. 7, a change of the toner concentration is within the acceptable range. Moreover, although other image items were evaluated, it was confirmed that the almost same results as the initial images were obtained.

Experiment 6

In this experiment, the influence of the peripheral speed (Vm) of the sleeveless roll magnet 40 on image quality was examined using the two-component developer used in experiment 1.

Four levels of the peripheral speed of the sleeveless roll magnet (Vm) were used: half, twice, six times, and ten times as high as the peripheral speed of the photosensitive drum 30 (Vp=25 mm/s). The other conditions were the same as in experiment 1. The results are shown in Table 6.

TABLE 6

| example | 20 | 21 | 22 | 23 |
|---|---|---|---|---|
| speed Vm relatine to Vp | 0.5 Vp | 2 Vp | 6 Vp | 10 Vp |
| image density | 1.1 | 1.4 | 1.4 | 1.4 |
| absence of fogging | good | good | good | bad |
| absence of spreadness of toner | good | good | good | bad |
| uniformity of width of thin lines | bad | good | good | good |
| remarks | toner concentration is set to 50 wt % | | | large torgue |

The Vm (the peripheral speed of the sleeveless roll magnet 40) relative to Vp (the peripheral speed of the photosensitive drum 30; =25 mm/s in this experiment) in Table 6 is represented as a multiple of Vp. For example, if Vm is six times as high as Vp, it is expressed as 6 Vp.

Table 6 shows that images obtained have a low density and the width of thin lines therein is non-uniform when Vm is half as high as Vp and images contain fogging and spreadness of toner when Vm is ten times as high as Vp. This show that Vm should be set to a certain multiple of Vp or more to obtain a high image density (1.3 or more in general) and to maintain the uniformity of the width of thin lines within an allowable range.

This also shows that Vm should be set to a certain multiple of Vp or less to prevent fogging and spreadness of toner.

These results show that Vm set within a certain range relative to Vp provides high image quality. Table 6 shows that good results are obtained when Vm is twice or six times as high as Vp.

Experiment 7

Images were created and evaluated under the same conditions as in experiment 1 (however, the toner concentration is 50 wt. %) except that five types of roll magnets with different numbers of magnet poles and surface magnetic flux density (Bo) were used and that the peripheral speed of the roll magnets was varied between two levels. The results are shown in Table 7.

TABLE 7

| example | 24 | 25 | 26 | 27 | 28 |
|---|---|---|---|---|---|
| h (mm) | 0.4 | 0.5 | 1.0 | 1.0 | 1.3 |
| M | 40 | 32 | 16 | 10 | 8 |
| Bo (G) | 50 | 200 | 550 | 1000 | 1200 |
| Vm (mm/s) | 100 | 100 | 100 | 150 | 150 |
| image density | 1.42 | 1.40 | 1.39 | 1.35 | 1.33 |
| absence of fogging | common | good | good | good | good |
| absence of spreadness of toner | good | good | good | good | good |
| uniformity of width of thin lines | good | good | good | good | common |

Table 7 shows that high-quality images are obtained when (h) is less than 2 mm and Bo is within a range of 50 to 1,200 G. However, fogging somewhat more frequently occurs when Bo is low, and the width of thin lines is non-uniform when (h) is large. Table 7 also shows that (h) is preferably 1.0 mm or less.

Experiment 8

The influence of the amount of the magnetic powder in the magnetic toner were examined in this experiment. An iron powder carrier and magnetic toner the same as in experiment 1 were used as a two-component developer, but the amount of magnetic powder (magnetite) was varied among four levels (0, 25, 60, and 75 wt. %) to examine its influence.

The component ratios of the charge-controlling agent and the release agent in the magnetic toner were the same as in experiment 1, and the amount of styrene-n-butylmethacrylate as a binder resin was varied depending on the amount of magnetic powder. That is, the sum amount of the magnetic powder and the binder resin was adjusted to be constantly 95 wt. % of the overall toner.

Moreover, the peripheral speed of the sleeveless roll magnet 40 (Vm) was set five times as high as that of the photosensitive drum 30 (Vp=25 mm/s). The other conditions were the same as in experiment 1. The results are shown in Table 8.

TABLE 8

| example | 29 | 30 | 31 | 32 |
|---|---|---|---|---|
| content of magnetic powder in toner (wt %) | 0 | 25 | 60 | 75 |
| image density | 1.4 | 1.38 | 1.35 | 1.2 |
| absence of fogging | good | good | good | good |
| absence of spreadnes of toner | good | good | good | good |
| uniformity of width of thin lines | good | good | good | good |
| remarks | toner concentration is set to 50 wt % and Vm is set to five times as high as Vp | | | |

Table 8 shows that the image density decreases when the content of the magnetic powder is 75 wt. % if the content is varied among four levels within a range of 0 to 75 wt. %. This shows that, in the aspect of image quality, the content of magnetic powder in toner is preferably set to a certain value or less.

The table also shows that, even with 0% magnetic powder, a high image quality is maintained. This indicates that the image forming method in accordance with this invention allows non-magnetic toner to be used through the use of a carrier made of a soft magnetic material even if a sleeveless roll magnet is used. The table also shows that high image quality is ensured without fogging or toner spreadness even if the concentration of non-magnetic toner is 50%.

These results can be understood as follows: Conventional roll magnets with a sleeve on their surface require the concentration of non-magnetic toner to be low to apply a sufficient amount of charge to the toner on the surface of the rotating sleeve because the developer slips on the surface of the sleeve. However, this invention employs a doctor blade to promptly charge the developer so that the developer can move quickly and reliably, thereby allowing it to follow the rotation of the sleeveless roll magnet 40 without slipping.

Experiment 9

Images were formed and evaluated under the same conditions as in experiment 1 except that a mixture of two types (A and B) of magnetic powder with different materials and particle sizes was used as the magnetic carrier. The results are shown in Table 10.

The binder type carrier was prepared using 20 pts.wt. of styrene-acrylic copolymer (experiment 1) and 80 pts.wt. of magnetite (EPT500 manufactured by Toda Kogyo Corporation) in the same manner as in experiment 1.

TABLE 9

| | No. | 1 | 2 | 3 | 4 |
|---|---|---|---|---|---|
| carrier A | average particle size (μm) | 60 | 100 | 120 | 50 |
| | material | Ni—Zn ferrite | Cu—Zn ferrite | Ba—Ni—Zn ferrite | binder type |
| | shape | sphere | sphere | sphere | no-spherical |
| | $\delta_{1000}$ | 62 | 58 | 48 | 35 |
| carrier B | average particle size (μm) | 10 | 25 | 40 | 25 |
| | material | iron powder | iron powder | iron powder | iron powder |
| | shape | sphere | sphere | block | flat |
| | $\delta_{1000}$ | 65 | 68 | 70 | 72 |

TABLE 10

| example | 33 | 34 | 35 | 36 |
|---|---|---|---|---|
| carrier | 1 | 2 | 3 | 4 |
| mixing ratio (A:B) | 1:1 | 1:3 | 2:1 | 1:1 |
| image density | 1.37 | 1.41 | 1.40 | 1.35 |
| absence of fogging | good | good | good | good |
| absence of spreadness of toner | good | good | good | good |
| uniformity of width of thin lines | good | good | good | good |

Table 10 shows that each carrier produces high-quality images.

Experiment 10

Images were formed and evaluated under the same conditions as in experiment 1 except that a DC bias voltage of −400 V and a AC bias voltage were applied to the doctor blade.

The results are shown in Table 11.

TABLE 11

| | example | | 37 | 38 | 39 | 40 | 41 |
|---|---|---|---|---|---|---|---|
| developer | carrier | example of | 1 | 1 | 1 | 1 | 1 |
| | toner | experimene No. | 1 | 1 | 3 | 3 | 1 |
| | toner concentration | | 50 | 50 | 50 | 50 | 50 |

TABLE 11-continued

| | example | 37 | 38 | 39 | 40 | 41 |
|---|---|---|---|---|---|---|
| | (wt %) | | | | | |
| AC bias | Vp-p (V) | 200 | 200 | 100 | 300 | — |
| voltage | f (KHz) | 0.5 | 5 | 8 | 1 | — |
| image | image density | 1.33 | 1.35 | 1.39 | 1.37 | 1.41 |
| quality | fogging density | 0.09 | 0.08 | 0.09 | 0.08 | 0.10 |
| | absence of spreadness of toner | good | good | good | good | good |
| | uniformity of width of thin lines | good | good | good | good | good |

Table 11 shows that fogging is reduced by the application of an AC bias voltage.

Although, in this experiment, the sleeveless roll magnet 40 has no conventional sleeve provided on its magnetized surface, a conductive resin tube (for example, thermally contractive polyester or a fluorine resin) may be used to cover the roll magnet to apply bias voltage. In this case, it was confirmed that high image quality was obtained at a low temperature (10° C.) and a low humidity (relative humidity: 20%).

In particular, the use of a flat iron powder carrier provides very high-quality images. Furthermore, if a small inexpensive ferrite magnet integral with a shaft is used as the sleeveless roll magnet 40, the application of the image forming method of this invention effectively improves image quality and reduces the cost and size of the device.

The first invention can use a two-component developer to effectively eliminate the common disadvantage of the prior art involved in the use of a sleeveless roll magnet wherein a sufficient amount of charges is not applied to the toner. In particular, since the first invention does not require a special device for applying a sufficient amount of charge to the toner or a significant change in the basic configuration of the mechanism of the development device, it can substantially expand the sleeveless roll magnet market and promote the reduction of the cost and size of image formation devices such as copying machines, facsimile terminal equipment, and printers.

Moreover, by allowing a two-component developer including a non-magnetic toner to be used for a sleeveless roll magnet whose size can be reduced, this invention can facilitate the reduction of the cost and size of color copying machines that use color toner in a developer, thereby further expanding the color copying machine market.

Embodiment 2-1

Figure 2:
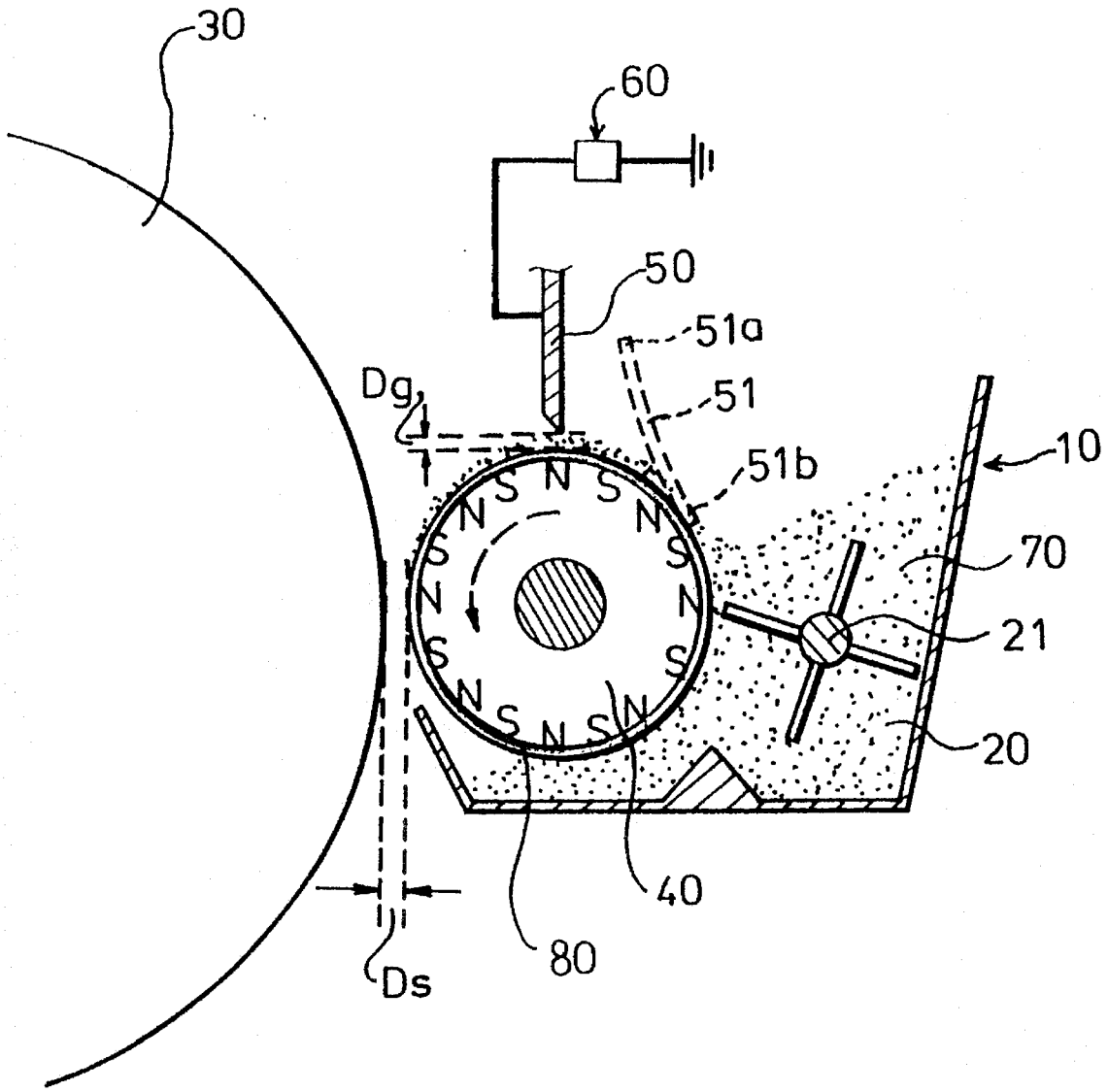
FIG. 2 is a typical view of the main part of an image forming device for implementing the second invention.

FIG. 2 is a typical view of the main part of an image formation device for implementing the second embodiment.

The image informing device shown in FIG. 2 has a configuration approximately the same as in the image formation device shown in FIG. 1 except that a conductive layer 80 is provided on the surface of the sleeveless roll magnet 40 as a developer conveying member. In the image information device shown in FIG. 2, the same numeral is given for a same configuration component shown in FIG. 1 . The corresponding parts carry the same reference numerals as in FIG. 1 and their description is therefore omitted.

The conductive layer 80 is uniformly coated on the surface of the magnet constituting a developer conveying member, and the conductivity of the surface is set to $10^6$ Ω.cm or less. In this embodiment, a thermally contractive conductive (electric resistance: $10^4$ Ω.cm) polyester tube was used as the conductive layer 80 and coated on the surface of the magnet so as to have a uniform thickness of 50 μm. Other conductive resins (for example, fluororesins to which carbon black is added) or metal foil (for example, austenitic stainless steel (for example, SUS304) foil) may be used to apply conductivity.

This magnet should be integrally formed, however, to prevent nonuniform development as in FIG. 1.

The number of poles in the magnet is preferably 8 to 60 so as to correspond to the preferable range of the magnetic flux density (Bo) of the surface of a magnetic roll of 50 to 1,200 G, as in the embodiment in FIG. 1. A more preferable range of Bo is 100 to 800 G.

If the peripheral speed of the photoreceptor 30, and the outer diameter, the number of magnetic poles, and the peripheral speed of the sleeveless roll magnet 40 are represented as Vp (mm/s), D (mm), M, and Vm (mm/s), respectively, the pitch of magnetic poles opposing to the photo receptor per a unit of time (h) can be expressed as in the following equation:

$$h=\pi D.Vp/M.Vm(mm)$$

D, M, and V are preferably set in such a way that the value of (h) is less than 2.

(h) is the pitch of the magnetic poles when they are opposed to the surface of the photosensitive drum per unit of time. If the value of (h) is larger than 2, development will be nonuniform. The value of (h) is preferably 1 mm or less. M and Vm may be increased to decrease (h). The surface magnetic flux density of the sleeveless roll magnet 40, however, will be too low if the value of M is too high, while the inconvenience described above is likely to occur as the value of Vm increases. Thus, the value of (h) is preferably within a range of 0.4 to 1.0 in terms of practicality.

In addition, although the bias voltage in this embodiment is DC and an AC bias voltages applied from the doctor blade 50 made of a non-magnetic conductive material (for example an aluminum alloy or brass), these voltages may be applied from the cylindrical magnet or a shaft supporting the magnet if the overall magnet is conductive. Furthermore, the AC bias voltage superimposed on the DC voltage is preferably 20 kHz or less (more preferably 10 kHz and has a low frequency) so as to promote the reduction of fogging.

The image forming device of the above configuration is also used in embodiment 2-2 described below.

As in the first embodiment, an ordinary two-component developer comprising a carrier and non-magnetic toner or a two-component developer comprising a carrier and magnetic toner may be used as the magnetic developer 70. A magnetic carrier and non-magnetic toner are used in this embodiment, while a magnetic carrier and magnetic toner are used in embodiment 2-2 described below.

Those magnetic particles such as iron powder, soft ferrites, magnetites, or binder particles with a magnetic powder distributed in a resin which have an average particle size of 10 to 150 μm and a magnetization of 50 emu/g or more as measured in a magnetic field of 1,000 Oe can be used as a carrier. A carrier 50 emu/g in magnetization is preferably used in the aspect of the adhesion of the carrier.

If a ferrite or a magnetite is used, a ferrite with a magnetization of 55 to 80 emu/g (saturation magnetization: 65 to 95 emu/g) as measured in magnetic field of 1,000 Oe or a magnetite with magnetization of 58 emu/g or more (saturation magnetization: 86 emu/g) as measured under the same condition is preferably used.

Among the above carriers, this embodiment and embodiment 2-2 described below used an iron powder carrier, in particular, such a carrier with a non-spherical flat shape. The average particle size of the iron powder carrier to be used is preferably within a range of 10 to 50 μm because a sufficient amount of charge must be applied to the toner when the average particle size of the carrier is 50 μm or less whereas the carrier is likely to adhere to the surface of the photosensitive drum when the average particle size is less than 10 μm.

More than one of the magnetic particle types described above may also be mixed. For example, large magnetic particles 60 to 120 μm in average particle size may be mixed with small magnetic particles 10 to 50 μm in average particle size, or binder magnetic particles 10 to 50 μm in average particle size may be mixed with iron powder of the same average particle size. In this case, the mixing rate can be determined by considering the size and magnetic characteristics of magnetic particles to be mixed.

Either magnetic or non-magnetic toner can be used. In the aspect of transferability, however, the toner is preferably insulating (volume resistivity: $10^{14}$ Ω.cm or more) and easily charged when brought into contact with a carrier (triboelectric charge: 10 μC/g or more at absolute volume). The toner concentration is preferably within a range of 10 to 90 wt. % for the magnetic toner, and 5 to 60 wt. % for the non-magnetic toner.

In addition, in the aspect of image quality, the magnetic toner preferably contains 20 to 70 wt. % of magnetic powder. Toner may otherwise scatters if the content of the magnetic powder is too low, while the toner may not be easily fixed if the content is too high.

The composition of the toner is approximately the same as in the toner described in the first embodiment.

Magnetization, volume resistivity, and triboelectric charge were measured in the same manner as in the first embodiment,

Experiment 11

The two-component developer used in this experiment comprises a magnetic carrier and non-magnetic toner, To prepare a magnetic carrier 100 pts.wt. of flat iron powder (MC-SI manufactured by Hitachi Metals Ltd.) was mixed in a mixer with 1 pts.wt. of silicone resin for covering the surface of the powder, and the mixture was then thermally treated in an air circulating furnace at 150° C. After cooling, the mixture was classified to obtain an iron powder carrier 25 μm in average particle size.

This iron carrier had a magnetization of 70 emu/g (saturation magnetization: 200 emu/g) in a magnetic field of 1,000 Oe.

To prepare the non-magnetic toner, 85 pts.wt. of styrene-n-butylmethacrylate copolymer (weight average molecular weight: $21\times10^4$; number average molecular weight: about $1.6\times10^4$) as a binder resin, 10 pts.wt. of carbon black (#50 manufactured by Mitsubishi Kasei Kogyo K. K.) as a coloring agent, 3 pts.wt. of polypropylene (TP32 manufactured by Sanyo chmical Co., Ltd.) as a release agent, and 2 pts.wt. of charge-controlling agent (Bontron S34 manufactured by Orient chemical Industries, Ltd.) were dry-mixed in a mixer. The mixture was then heated, kneaded, cooled, and solidified. It was then pulverized using a jet mill, or a rotary stator crusher, The pulverized material was then classified and a non-magnetic toner 9 μm in volume average particle size was obtained.

The above iron powder carrier and non-magnetic toner were mixed so as to obtain a toner concentration of 50 wt. %, thereby preparing a two-component developer. This developer was used to evaluate image quality through reverse development.

The sleeveless roll magnet. 40 used in this example of experiment was a roll magnet having a diameter of 20 mm and used for A4-sized paper wherein a cylindrical ferrite magnet is fixed to a metal shaft SUS304 foil (50 μm) is formed on its surface, and 16 magnet poles are located symmetrically. This roll magnet 40 had a surface magnetic flux density of 550 G, and the unexposed area of the surface of the photosensitive drum 30 had a potential of −700 V.

A brass doctor blade 50 was used, and DC bias voltage of −550 V was applied to this doctor blade 50 for reverse development. The AC bias voltage superimposed on the DC bias voltage is described in Table 12 below.

In addition, the developing gap Ds was set to 0.4 mm and the doctor blade gap Dg were set to 0.3 mm. Furthermore, the peripheral speed of the sleeveless roll magnet 40 (Vm) was set six times as high as that of the photosensitive drum 30 (Vp=25 mm/s). Under the above conditions, the effect of this invention on the image quality was examined using the conductive sleeveless roll magnet 40. The results are shown in Table 12.

The final toner image were obtained by transferring the developed toner image by corona transfer unit on plain paper and then heat roll fixing (line pressure: 1 kg/cm, fixing temperature: 180° C.). Four items were evaluated: the image density, the fogging density, the absence of spreadness of toner, and the uniformity of the width of thin lines.

TABLE 12

| example | | 1 | 2 | 3 | 4 | 5 |
|---|---|---|---|---|---|---|
| AC bias voltage | Vp-p (V) | — | 100 | 500 | 1000 | 1500 |
| | f (KHz) | — | 8 | 1 | 0.2 | 1 |
| evaluation on image | image density | 1.35 | 1.37 | 1.39 | 1.40 | 1.42 |
| | fogging density | 0.12 | 0.09 | 0.07 | 0.10 | 0.11 |
| | absence of spreadness of toner | good | good | good | good | common |
| | uniformity of width of thin lines | good | good | good | good | common |

Vp-p and (f) are the peak-to-peak value and frequency of the AC bias voltage, respectively.

Table 12 shows that the image density obtained in experiments 1 to 5 is sufficient enough to be practical and present no problem regardless of the superimposition of the AC bias voltage. However, the fogging density was 0.12 and small fogging appeared when the AC bias voltage was not applied (experiment 1), while it was lower than 0.12 and fogging was prevented when the AC bias voltage was applied (experiments 1 to 5). However, the image quality of experiment 5 was worse than that of the other example because of the presence of dust and the non-uniformity of the width of thin lines.

These results indicate that a certain degree of superimposition of an AC bias on a DC bias effectively reduces or prevents fogging while maintaining image quality such as the density of images, the absence of spreadness of toner, and the uniformity of the width of thin lines.

Experiment 12

The effect of the concentration of toner on the image quality was examined under the same conditions as in experiment 1 except that the superimposed AC bias Vp-p and its frequency (f) had constant values, that is, 500 and 1 kHz, respectively. The results are shown in Table 13.

TABLE 13

| example | | 6 | 7 | 8 |
|---|---|---|---|---|
| toner concentration (wt %) | | 10 | 30 | 60 |
| evaluation on images | image density | 1.31 | 1.33 | 1.40 |
| | fogging density | 0.08 | 0.08 | 0.12 |
| | absence of spreadness of toner | good | good | good |
| | uniformity of width of thin lines | good | good | good |

Table 13 shows that the image density increases with the toner concentration but that fogging starts to occur when a certain range of concentration is exceeded if an AC bias voltage is superimposed under the same conditions.

Experiment 13

In this experiment, the effect of the pitch (h) (mm) of the magnetic poles opposed to a photosensitive drum per a unit of time image quality was examined when an AC bias voltage was superimposed. The AC bias Vp-p=500 V and its frequency (f)=0.5 Hz and the other conditions were the same as in experiment 1 with only (h) varied. The results are shown in Table 3.

TABLE 14

| example | 9 | 10 | 11 |
|---|---|---|---|
| h (mm) | 0.5 | 1.0 | 1.3 |
| Bo (G) | 200 | 1000 | 1200 |
| M | 32 | 10 | 8 |
| Vm (mm/s) | 100 | 150 | 150 |
| image density | 1.35 | 1.37 | 1.40 |
| fogging density | 0.07 | 0.09 | 0.10 |
| absence of spreadness of toner | good | good | good |
| uniformity of width of thin lines | good | good | good |

Table 14 shows that all of the experiments 9 to 11 produce good results in terms of the image density, the fogging density, the amount of spreadness of toner, and the nonuniformity of the width of thin lines but that (h) is preferably as small as possible so as to reduce fogging.

Embodiment 2-2

This embodiment uses a two-component developer comprising a magnetic carrier and magnetic toner, and the image forming device and its use and the developer in this embodiment are the same as in embodiment 1 unless otherwise specified in the experiments described below. The evaluation of images under these conditions is shown in experiments 4 to 6 below.

Experiment 14

The two-component developer used in this experiment comprises an iron powder carrier and magnetic toner. The iron powder carrier was manufactured in the same manner as in experiment 1, However, iron powder 50 μm in average particle size was used in this experiment.

To prepare the magnetic toner, 55 pts.wt. of styrene-n-butylmethacrylate copolymer (weight average molecular weight: $21\times10^4$; number average molecular weight: about $1.6\times10^4$) as a binding resin, 40 pts.wt. of magnetite (EPT500 manufactured by Toda Kogyo corporation) as a magnetic powder, 3 pts.wt. of polypropylene (TP32 manufactured by Sanyo chemical Co.,Ltd.) as a release agent, and 2 pts.wt. of charge-controlling agent (Bontron S34 manufactured by Orient chemical Industries,Ltd.) were dry-mixed in a mixer. The mixture was then heated, kneaded, cooled, and solidified. It was then pulverized using a jet mill, or a rotary stator crusher. The pulverized material was then classified to obtain a magnetic toner 9 μm in volume average particle size.

The above iron powder carrier and magnetic toner were mixed so as to obtain a toner concentration of 50 wt. %, thereby preparing a two-component developer, as in experiment 1. The image quality obtained when an AC bias voltage is superimposed on a DC bias voltage was evaluated under the same conditions as experiment 1.

TABLE 15

| example | | 12 | 13 | 14 | 15 | 16 |
|---|---|---|---|---|---|---|
| AC bias voltage | Vp-p (v) | — | 200 | 200 | 1000 | 1500 |
| | f (KHz) | — | 0.5 | 5 | 0.2 | 1 |
| evaluation of images | image density | 1.37 | 1.35 | 1.33 | 1.40 | 1.41 |
| | fogging density | 0.12 | 0.08 | 0.07 | 0.09 | 0.13 |
| | absence of spreadness of toner | good | good | good | good | common |
| | uniformity of width of thin lines | good | good | good | good | common |

Table 15 shows that experiments 12 to 16 provided a sufficient image density regardless of the superimposition of an AC bias voltage. However, the fogging density was 0.12, showing that small fogging appeared in both experiments 12 in which an AC bias voltage was not superimposed and experiment 16 in which an AC bias voltage was superimposed.

However, in experiments 13 to 15 in which an AC bias voltage was superimposed, the fogging density was lower than 0.12, showing that fogging was prevented.

The presence of spreadness of toner and the nonuniformity of the width of thin lines were also observed in experiment 16.

These results demonstrate that, as in experiment 1 which uses a two-component developer comprising a magnetic carrier and non-magnetic toner, a certain degree of superimposition of an AC bias on a DC bias effectively reduces or prevents fogging without deteriorating image quality such as the image density the amount of spreadness of toner, and the non-uniformity of the width of thin lines even if a two-component developer consisting of a magnetic carrier and magnetic toner is used.

Experiment 15

The influence of the toner concentration on the image quality was examined when a superimposed AC bias voltage and its frequency (f) were constant, that is, Vp-p=200 V and (f)=1 kHz and the other conditions were the same as in experiment 4. The results are shown in Table 16.

TABLE 16

| example | | 17 | 18 | 19 | 20 |
|---|---|---|---|---|---|
| toner concentration (wt %) | | 10 | 30 | 70 | 90 |
| evaluation on | image density | 1.38 | 1.38 | 1.40 | 1.40 |

TABLE 16-continued

| | example | 17 | 18 | 19 | 20 |
|---|---|---|---|---|---|
| image | fogging density | 0.07 | 0.07 | 0.10 | 0.11 |
| | absence of spreadness of toner | good | good | good | good |
| | uniformity of the width of thin lines | good | good | good | good |

Table 16 shows that the image dsensity increases and the fogging density decreases with an increase in the toner concentration when an AC bias voltage is superimposed under the same conditions. In particular, experiments 17 and 18 produced much better results than experiments 19 and 20 in which the toner concentration was 70 wt. or more.

Experiment 16

As in experiment 3 in this experiment, the effect of the spacing (h) (mm) between the photoreceptor and a magnet pole on image quality was examined when an AC bias was superimposed. Vp-p=500 and (f)=0.5 and the other conditions were the same as in experiment 4 with only (h) varied. The results are shown in Table 17.

TABLE 17

| example | 22 | 23 | 24 |
|---|---|---|---|
| h (mm) | 0.4 | 1.0 | 1.3 |
| Bo (G) | 50 | 750 | 1200 |
| M | 40 | 16 | 8 |
| Vm (mm/s) | 100 | 100 | 150 |
| image density | 1.40 | 1.41 | 1.41 |
| fogging density | 0.09 | 0.08 | 0.10 |
| absence of spereadness of toner | good | good | good |
| uniformity of width of thin lines | good | good | good |

As in experiment 13 Table 17 shows that all of the experiments 22 to 24 produced good results in terms of the image density and fogging, the amount of spreadness of toner, and the uniformity of the width of thin lines and that (h) is preferably as small as possible so as to prevent fogging.

The results of experiments 11 to 16 in Embodiments 2-1 and 2-2 demonstrated that fogging can be effectively reduced or prevented by using the sleeveless roll magnet in accordance with the second invention with a conductive surface and also using a two-component developer to form images while superimposing an AC bias voltage on a DC bias voltage. Furthermore, it was found that this effect increases with a decrease of (h). It was also found that this invention can maintain a high image quality at a low temperature (10° C.) and low humidity (Relative humidity: 20%).

According to the image forming method of the second invention, the use of a two-component developer effectively eliminates the common disadvantage of the prior art involved in the use of a sleeveless roll magnet wherein a sufficient amount of charge is not applied to the toner, and also effectively prevents fogging that may occur when applying a DC bias voltage to a conventional conductive roll magnet for development.

Although, in this experiment, the sleeveless roll magnet 40 has no conventional sleeve provided on its magnetized surface, a conductive resin tube (for example,thermally contractive polyester or a fluorine resin) may be used to cover the roll magnet to apply bias voltage. In this case, it was confirmed that high image quality was obtained at a low temperature (10° C.) and a low humidity (relative humidity: 20%).

This invention thus facilitates the reduction of the cost and size of image forming devices such as copying machines, facsimile terminal equipment, and printers using a sleeveless roll magnet that can be miniaturized. Moreover, the use of color toner in a developer promotes the reduction of the cost and size of color copying machines, thereby further expanding the color copying machine market.

Embodiment 3

Figure 3:
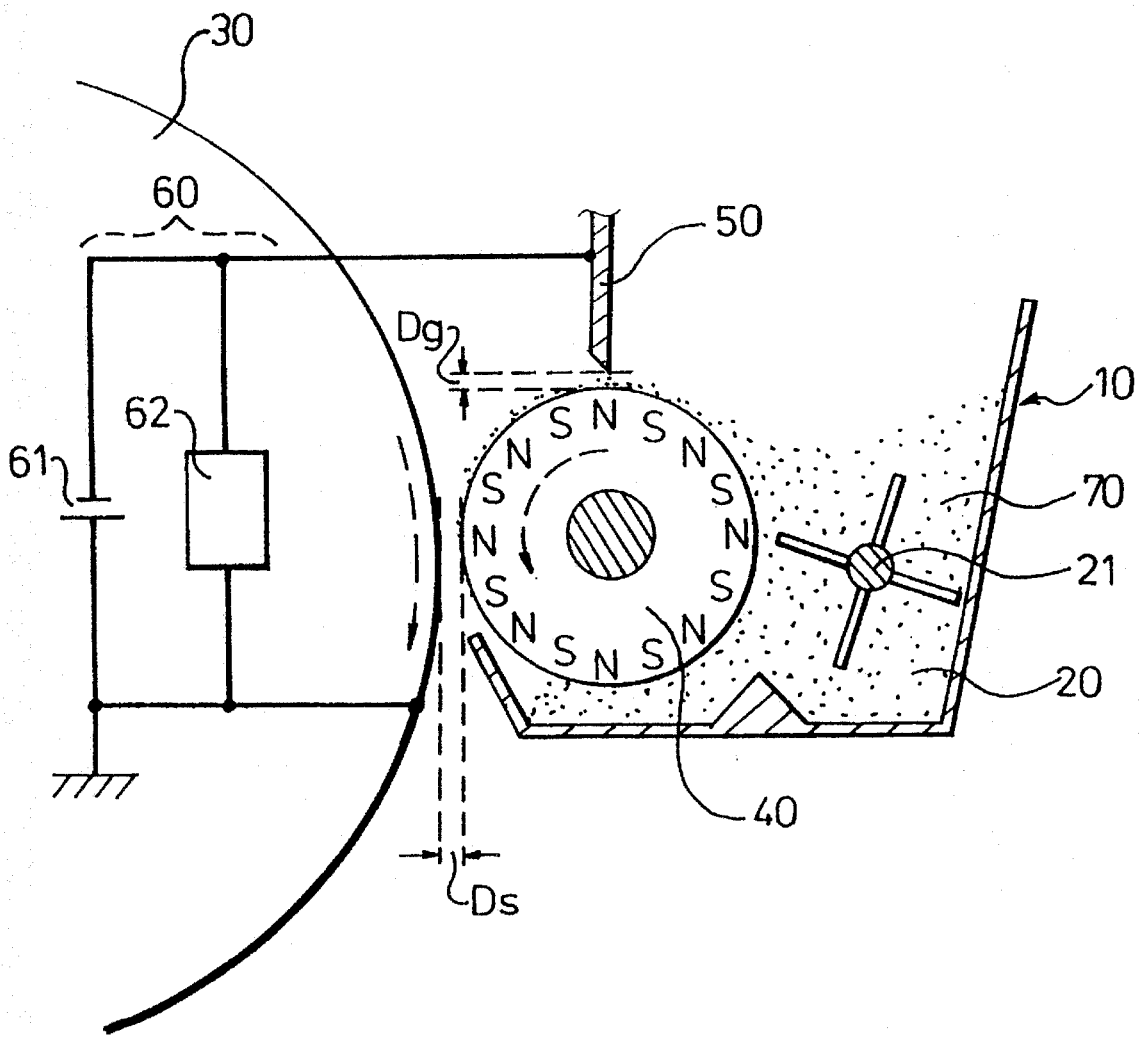
FIG. 3 is a typical view of the main part of an image forming device for implementing the third invention.

FIG. 3 is a typical view of the main part of an image forming device for implementing the third embodiment.

The image forming device shown in FIG. 3 has approximately the same configuration as the device shown in FIG. 1, and is particularly preferable for jumping development. In the image forming device shown in FIG. 3, the corresponding components carry the same reference numerals as in FIG. 1. The description of such member is therefore omitted.

In FIG. 3, a sleeveless roll magnet 40 is formed, for example, of a semiconductive or insulating isotropic ferrite magnet with a volume specific resistance of 106 Ω.cm or more, and has a plurality of magnetic poles axially extending on its outer circumferential surface. The roll magnet 40 is also formed like a cylinder, and rotatably provided at the bottom of the developer hopper 20. Reference numeral 60 is a DC power supply connected between a doctor blade 50 and a photosensitive drum 30 and formed so as to apply an AC electric field with an AC bias voltage superimposed on a DC bias voltage between a magnetic developer 70 attracted and conveyed on the surface of the sleeveless roll magnet 40 and the photosensitive 30.

As in the first embodiment, the number of poles in the magnet is preferably between 8 and 60, corresponding to the preferable magnetic flux density (Bo) of a roll magnet of 50 to 1,200 G. A more preferable range of Bo is 100 to 800 G.

If the peripheral speed of the photosensitive drum 30 and the outer diameter, the number of poles, and the peripheral speed of the sleeveless roll magnet 40 are represented as Vp (mm/s), D (mm), M, and Vm (mm/s), respectively, D, M, and V are preferably set in such a way that h (mm) in Equation 1 below is less than 2.

$$h=\pi D.Vp/M.Vm \qquad \text{Equation 1}$$

The above (h) is the pitch surface of the magnetic poles when they are opposed to the photosensitive drum per a unit of time. If this value exceeds 2 mm, image density along rotational direction of the d rum will be nonuniform. The value of (h) is preferably 1 mm or less. To reduce (h), M and Vm may be increased. However, if the value of M is too large, the surface magnetic flux density of the sleeveless roll magnet 40 will be too low, and an increase in the value of Vm results in the above inconvenience. Consequently, (h) is preferably within a range of 0.4 to 1.0 in terms of practicality.

In addition, in the third embodiment, since the semiconductive or insulating sleeveless roll magnet 40 retains a magnetic developer 70 on its surface, the bias voltage is preferably applied from the doctor blade 50. In this case, the doctor blade 50 may be formed of a non-magnetic conductive material (for example an aluminum alloy or brass).

An AC bias voltage 62 superimposed on a DC bias voltage 61 preferably has a relatively low frequency of 20 kHz or less, more preferably, 10 kHz or less. The peak-to-peak value Vp-p is preferably within a range of 100 to 2,000 V, more preferably, 200 to 1,200 V.

Appropriate carriers include those magnetic particles such as iron powder, soft ferrites, magnetites, or binder particles with magnetic powder distributed in a resin which have an average particle size of 10 to 150 μm and a magnetization of 50 emu/g as measured in a magnetic field of 1,000 Oe. Carriers are likely to adhere to the surface of the photosensitive drum if the magnetization is less than 50 emu/g.

Carriers, in particular, iron powder carriers preferably have a flat shape, instead of a spherical shape, which is commonly used so as to be more effective.

Furthermore, it is particularly preferable that the average particle size of a carrier be 10 to 50 μm because a sufficient amount of charge is applied to toner when the average particle size is 50 μm or less while the carrier is likely to adhere to the surface of the photosensitive drum when the average particle size is less than 10 μm.

In the third embodiment, more than one type of the above magnetic particles may be mixed. For example, large magnetic particles 60 to 120 μm in average particle size may be mixed with small particle size magnetic particles 10 to 50 μm in average particle size, or binder type magnetic particles 10 to 50 μm in average particle size may be mixed with iron particles of the same average particle size.

The mixing rate can be determined by considering the size and magnetic characteristics of magnetic particles to be mixed.

In the third embodiment, appropriate magnetic developers 70 include those comprising magnetic toner alone, mixtures of magnetic toner and a magnetic carrier (concentration of toner: 10 to 90 wt. %), and mixtures of non-magnetic toner and a magnetic carrier (concentration of toner: 5 to 60 wt. %).

The composition of toner is approximately the same as in the first embodiment.

The magnetization, volume resistivity, and triboelectric charge were measured in the same manner as in the first embodiment.

Experiment 17

The results of image formation using the above image forming device and a magnetic developer 70 comprising magnetic toner alone are first described. The toner used contained magnetic powder, was negatively charged, and has an average particle size of 9 m, a volume specific resistivity of $5\times10^4$ Ω.cm, and triboelectric charge of −15 μc/g. The compounding ratio was 55 pts.wt. of styrene-n-butylmethacrylate copolymer ($Mw=21\times10^4$; $Mn=1.6\times10^4$), 40 pts.wt. of magnetic powder (EPT500 manufactured by Toda Kogyo Corporation), 3 pts.wt. of polypropylene (TP32 manufactured by Sanyo Chemical Co., Ltd.) and 2 pts.wt. of charge-controlling agent (Bontron S34 manufactured by Orient Chemical Industries, Ltd.).

The photosensitive (OPC drum) 30 was charged so as to have a surface potential of −700 V and a peripheral speed of 25 mm/s. The sleeveless roll magnet 40 was formed so as to have 32 poles and also have an outer diameter of 20 mm and a surface magnetic flux density of 250 G. The developing gap and the doctor blade gap were set to 0.3 mm and 0.1 mm, respectively. A DC bias voltage of −550 V was applied used. Table 1 shows the results of evaluation of images when the AC bias voltage was varied.

TABLE 18

| No. | 1 | 2 | 3 | 4 | 5 |
|---|---|---|---|---|---|
| AC bias voltage (Vpp) | 400 | 600 | 800 | 1000 | 1200 |
| frequency (Hz) | 1000 | 200 | 500 | 100 | 1000 |
| image density | 1.27 | 1.35 | 1.40 | 1.42 | 1.41 |
| fogging density | 0.07 | 0.08 | 0.08 | 0.10 | 0.13 |
| absence of spreadness of toner | good | good | good | good | good |
| uniformity of width of thin line | good | good | good | good | good |

Table 18 clearly shows that the image density in No. 1 is low partly because the AC bias voltage is low. The image density increases with the AC bias voltage, but, in No. 5, the fogging density is high and the image density is low. No spreadness of toner or non-uniform thin lines were observed in any of the examples.

Experiment 18

Table 19 shows the results of the evaluation of images similar to that in the preceding experiment using a magnetic developer comprising a mixture of the above magnetic toner and a magnetic carrier consisting of flat iron powder (covered with a styrene-acrylate copolymer and having a volume specific resistivity of $10^8$ Ω.cm). In this case, developing conditions were the same as in the preceding experiment with the magnetic developer comprising the magnetic toner alone except that the development gap, doctor gap, and DC bias voltage were 0.5 mm, 0.2 mm, and −550 V, respectively.

TABLE 19

| No. | 6 | 7 | 8 | 9 |
|---|---|---|---|---|
| AC bias boltage (Vpp) | 400 | 800 | 1000 | 1200 |
| frequency (Hz) | 500 | 100 | 2000 | 500 |
| image density | 1.33 | 1.41 | 1.38 | 1.39 |
| fogging density | 0.08 | 0.09 | 0.11 | 0.12 |
| absence of spreadness of toner | good | good | good | good |
| uniformity of thin line | good | good | good | good |

Table 19 clearly shows that this magnetic developer produces images containing no spreadness of toner or non-uniform thin lines but that the fogging density is high in No. 9 in which a high AC bias voltage was applied.

Experiment 19

Table 3 shows the results of the evaluation of images using a magnetic developer comprising a mixture of non-magnetic toner (an average particle size of 9 μm, a volume specific resistivity of $6\times10^4$ Ω.cm, and a triboelectric charge of −23 μc/g) comprising 85 pts.wt. of styrene-n-butylmethacrylate copolymer, 10 pts.wt. of carbon black (#50 manufactured by Mitsubishi Kasei Kogyo K. K.), 3 pts.wt. of polypropylene (TP32 manufactured by Sanyo chemical Co.,Ltd.), and 2 pts.wt. of charging control agent (Bontron S34 manufactured by Orient chemical Industries, Ltd.), and a magnetic carrier consisting of flat iron powder (no surface coating) having an average particle size of 25 μm. In this case, developing conditions were the same as in the preceding experiment except that the permanent magnet component 4 was formed to have 16 poles and a surface magnetic flux density of 350 G and that the toner concentration, the developing gap, the doctor blade gap, and the DC bias voltage were varied.

TABLE 20

| No. | 10 | 11 | 12 | 13 | 14 | 15 | 16 | 17 | 18 | 19 | 20 | 21 |
|---|---|---|---|---|---|---|---|---|---|---|---|---|
| toner concentration (%) | 50 | 50 | 50 | 50 | 50 | 20 | 30 | 40 | 60 | 50 | 50 | 50 |
| developing gap (mm) | 0.5 | 0.5 | 0.5 | 0.5 | 0.5 | 0.4 | 0.4 | 0.4 | 0.6 | 0.6 | 0.6 | 0.4 |
| docter gap (mm) | 0.2 | 0.2 | 0.2 | 0.2 | 0.2 | 0.2 | 0.2 | 0.2 | 0.2 | 0.3 | 0.4 | 0.1 |
| DC bias voltage (V) | −550 | −550 | −550 | −550 | −550 | −550 | −550 | −550 | −550 | −400 | −400 | −550 |
| AC bias voltage (Vpp) | 1000 | 1000 | 1000 | 200 | 400 | 1000 | 1000 | 1000 | 1000 | 1200 | 800 | 1000 |
| frequency (Hz) | 200 | 1000 | 0000 | 500 | 500 | 200 | 200 | 200 | 200 | 1000 | 1000 | 200 |
| image density | 1.40 | 1.38 | 1.35 | 1.31 | 1.33 | 1.35 | 1.37 | 1.41 | 1.42 | 1.38 | 1.35 | 1.41 |
| fogging density | 0.08 | 0.07 | 0.08 | 0.07 | 0.07 | 0.08 | 0.08 | 0.09 | 0.12 | 0.10 | 0.09 | 0.09 |
| absence of spreadness of toner | good | good | good | good | good | good | good | good | good | good | good | good |
| uniformity of thin line | good | good | good | good | good | good | good | good | good | good | good | good |

Table 20 obviously demonstrates that, in Nos. 10 to 14, the image density is high when the AC bias voltage is high if the toner concentration, the development gap, the doctor blade gap, and DC bias voltage are constant. The image density then increases with the toner concentration in the magnetic developer, but in No. 18, the fogging density is high and image quality deteriorates. When the doctor blade gap is widened (Nos. 19 and 20), the image density is not substantially reduced compared to that in the example with a smaller doctor gap (No. 21). No spreadness of toner or non-uniform thin lines were observed in any of the examples.

With the above configuration and action, the third embodiment has the following effects:

(1) Since the developing roller comprises a permanent magnet component alone, the developing device can be miniaturized and the overall image forming device can thus be miniaturized.

(2) Since the permanent magnet member supporting a magnetic developer is hard, its surface is not easily subject to wear or changes over time. As a result, this invention can improve the durability of the member.

(3) Stable and high-quality images are maintained even if the developing gap is widened.

(4) Since the concentration of toner in the magnetic developer can be set over a wide range, the need to use, for example, a toner concentration control means is avoided, thereby enabling the overall device to be miniaturized.

(5) The permanent magnet member constituting a developing roller need not be machined with high accuracy, reducing manufacturing cost.

Embodiment 4-1

Figure 4:
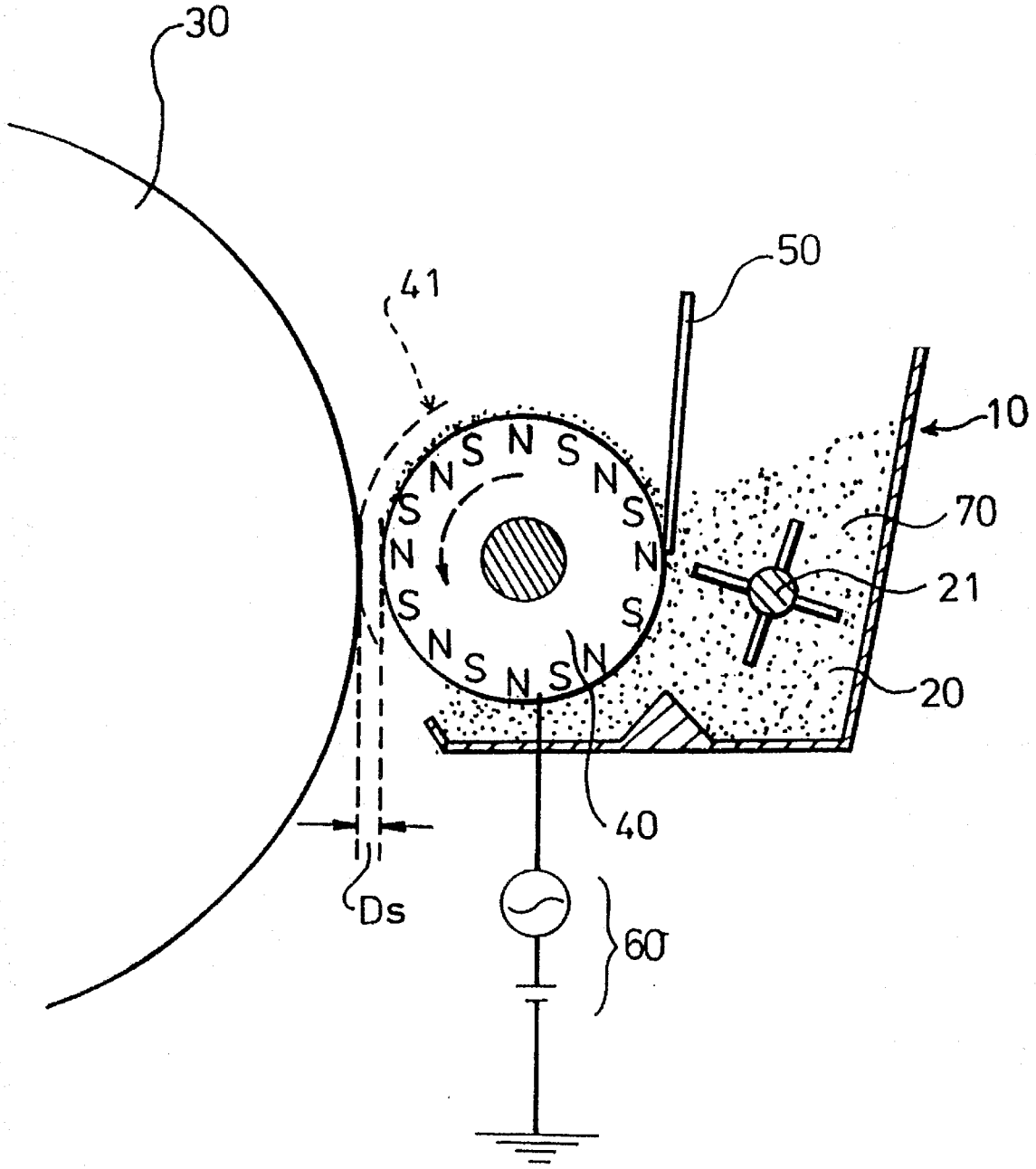
FIG. 4 is a typical view of the main part of an image forming device for implementing the fourth invention.
Figure 5:
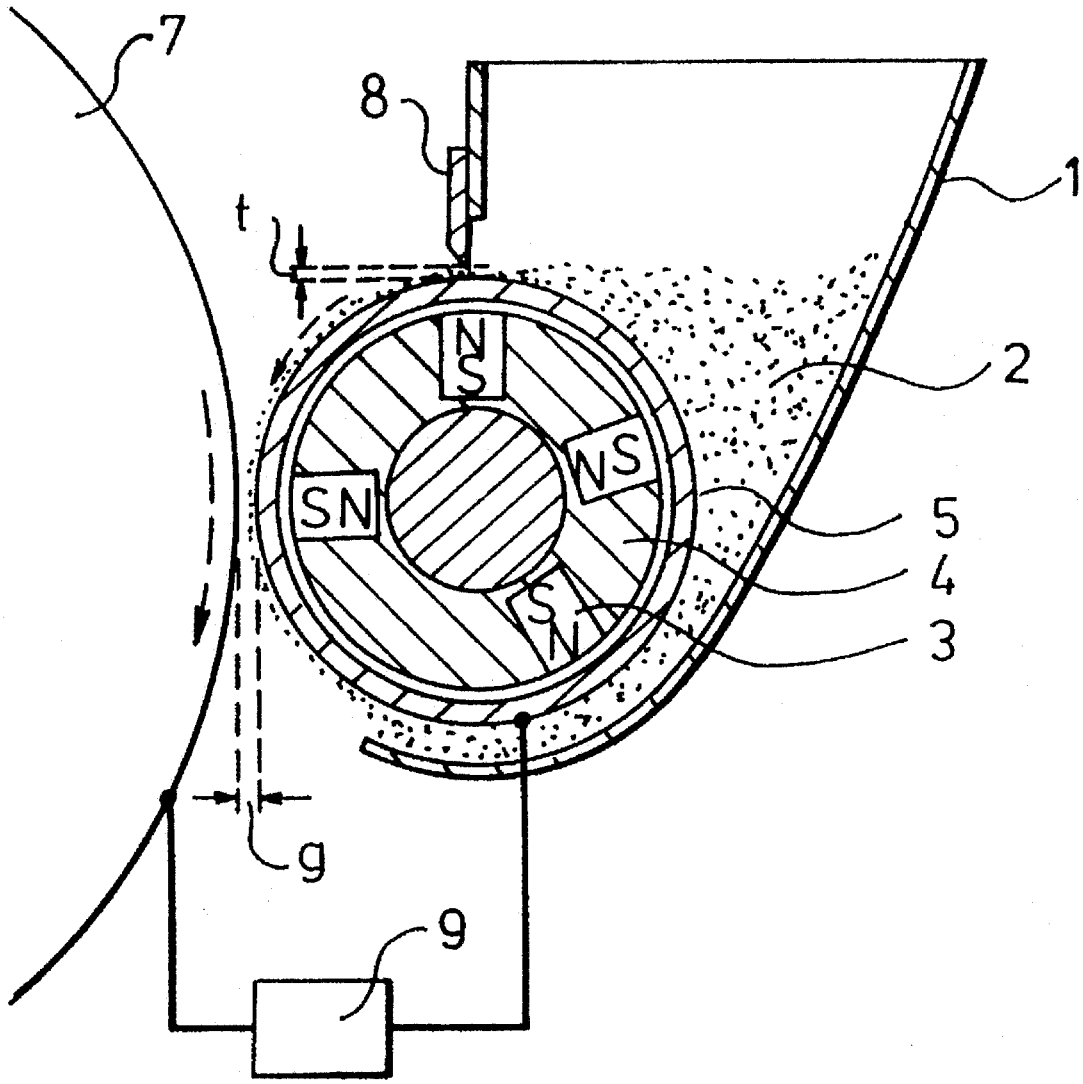
FIG. 5 is a typical view of the main part of the conventional image forming device.

FIG. 4 is a typical view of the main part of an image formation device for implementing the fourth embodiment.

The image formation device shown in FIG. 4 has approximately the same configuration as the device shown in FIG. 1 except for the placement of the doctor blade 50 and the method for applying the bias power supply 60. In the image formation device shown in FIG. 4, the corresponding components carry the same reference numerals as in FIG. 1. The description of such components is therefore omitted.

In FIG. 4, development is carried out in such a manner that a photosensitive drum 30 does not contact the sleeveless roll magnet 40. This developing can be performed by either the magnetic brush development method of using a magnetic brush formed of a magnetic developer 70 to rub the surface of the photosensitive drum 30 or the jumping developing method of flying the magnetic developer 70 onto the surface of the photosensitive drum 30 from the sleeveless roll magnet 40.

In FIG. 4, a sleeveless roll magnet 41 (shown with the dotted line) as contacting the surface of the photosensitive drum 30 with a surface hardness smaller than that of the surface of the photosensitive drum 30 (preferably 60 JIS A or less) may be used as described below to execute contact development wherein the sleeveless roll magnet 41 contacts the surface of the photosensitive drum 30 via developer layer.

The doctor blade 50 is provided on the surface of the sleeveless roll magnet 40 (or 41) SO that the tip portion of the doctor blade 50 contacts the surface (that is, Dg=0). In this case, the doctor blade 50 may comprise an elastic blade formed of a magnetic material such as an SK steel (or non-magnetic material such as SUS304 or phosphor bronze).

The magnet constituting the developer conveying member has approximately the same configuration as the magnet shown in FIG. 1. However, when used for contact development, the magnet may be integrally formed by kneading a rubber material (such as a urethane, silicone, or butyl rubber), magnetic powder (such as a ferromagnetic powder such as ferrite powder or rare earth magnet powder), and a conductive agent (such as carbon black or carbon fibers) for allowing a bias voltage to be applied.

The number of poles in a magnet is preferably between 8 and 60 corresponding to the preferable range of the magnetic flux density (Bo) of the sleeveless roll magnet 40 of 50 to 1,200 G. A more preferable range of Bo is 100 to 800 G.

If the peripheral speed of the photosensitive drum 30 and the outer diameter, the number of poles, and the peripheral speed of the roll magnet 40 are represented as Vp (mm/s), D (mm), M, and Vm (mm/s), respectively, the spacing (h) between the photoreceptor and a magnet pole can be expressed by the following equation:

$$h=\pi D.Vp/M.Vm(mm)$$

D, M, and V are preferably set in such a way that h (mm) is less than 2.

The above (h) is the pitch between the magnetic poles when they are opposed to the photosensitive drum per a unit of time. If this value exceeds 2 mm, image density along the rotational direction of the drum will be non-uniform. The value of (h) is preferably 1 mm or less. To reduce (h), M and Vm may be increased. However, if the value of M is too large, the magnetic flux density of the surface of the sleeveless roll magnet 40 will be too low, and an increase in the value of Vm results in the above inconvenience. Consequently, (h) is preferably within a range of 0.4 to 1.0 in terms of practicality.

In the fourth invention, since a magnetic developer 70 is held on the surface of the sleeveless roll magnet 40 with the above configuration, a bias voltage must be applied to the developing region. The bias power supply 60 is thus connected so that the DC bias voltage is applied to the sleeveless roll magnet 40 or 41 and that an AC bias voltage is applied between the roll magnet and the surface of the photosensitive drum 30.

The AC bias voltage superimposed on a DC bias voltage is preferably a low-frequency AC bias voltage of 10 kHz or less so as to reduce fogging.

The image forming device of the above configuration is al so used in embodiment 4-2 described below.

The magnetic developer 70 is an ordinary single-component developer comprising a magnetic toner.

In the aspect transferability, the magnetic toner used in this embodiment is preferably insulating (volume resistivity: $10^4$ Ω.cm or more) and easily charged when brought into contact with the doctor blade 50 (triboelectric charge: 10 μc/g or more at the absolute value).

The content of the magnetic powder in the magnetic toner is preferably within 20 to 70 wt. %. Toner may scatter if the content of magnetic powder is too small, while the toner is not easily fixed if the content is too large.

In addition, the volume resistivity and triboelectric charge of the magnetic toner were measured under the same conditions as in the first embodiment. The composition of the toner is approximately the same as in the first embodiment.

Experiment 20

A single-component developer comprising a magnetic toner was prepared for this experiment as follows: 55 pts.wt. of styrene-n-butylmethacrylate copolymer (weight average molecular weight: $21\times10^4$; number average molecular weight: about $1.6\times10^4$) as a binder resin, 40 pts.wt. of magnetite (EPT500 manufactured by Toda Kogyo Corporation) as magnetic powder, 3 pts.wt. of polypropylene (TP32 manufactured by Sanyo chemical Co.,Ltd.) as a release agent, and 2 pts.wt. of a charge-controling agent (Bontron S34 manufactured by Orient chemical Industries,Ltd.) were dry-mixed in a mixer.The mixture was then heated, kneaded, cooled, and solidified. It was then pulverized using a jet mill, or a rotary stator crusher. The pulverized material was then classified to obtain a magnetic toner $10^{14}$ Ω.cm in volume resistivity, 15 μc/g in triboelectric charge, and 9 μm in volume average particle size.

The sleeveless roll magnet 40 used in this experiment was a roll magnet having a diameter of 20 mm and used for A4-sized paper wherein a cylindrical ferrite magnet was fixed to a metal shaft and 16 poles were located symmetrically. This roll magnet 40 had a surface magnetic flux density of 550 G and the unexposed area of the surface of the photosensitive drum 30 had a potential of −700 V.

A doctor blade 50 was made of SUS 304, and not only DC bias voltage of −550 V but also the AC bias voltage superimposed on it and described in Table 21 below was applied to this doctor blade as a developing bias voltage.

The developing gap Ds was set to 0.3 mm and noncontact development was carried out. Furthermore, the peripheral speed of the sleeveless roll magnet 40 (Vm) was set six times as high as that of the photosensitive drum 30 (Vp=25 mm/s). Under the above conditions, the effect of this invention on image quality was examined using the sleeveless roll magnet 40 with the above configuration. The results are shown in Table 21.

The final toner images were obtained by transferring the developed toner image by corona transfer unit onto plain paper and then heat roller fixing (line pressure: 1 kg/cm, fixing temperature: 180° C.). Four items were evaluated: the image density, the fogging density, the amount of spreadness of toner, and the uniformity of the width of thin lines.

TABLE 21

| | example | 1 | 2 | 3 | 4 |
|---|---|---|---|---|---|
| AC bias voltage | Vp-p (v) | 200 | 500 | 1000 | 1500 |
| | f (KHz) | 1 | 0.2 | 5 | 0.5 |
| evaluation of images | image density | 0.85 | 1.25 | 1.37 | 1.40 |
| | absence of fogging | good | good | good | good |
| | absence of speadness of toner | good | good | good | good |
| | uniformity of width of thin lines | good | good | good | good |

Vp-p and (f) represent the peak-to-peak value and frequency of an AC bias voltage, respectively.

Table 1 shows that, in non-contact development using a single-component developer, the image density increases with the voltage of a superimposed AC bias voltage when the frequency is constsant.

The table also shows that fogging or spreadness of toner not occur and thin lines are uniform in all of the example.

Experiment 2

In this experiment, the influence of the pitch (h)(mm) was examined when an AC bias voltage was superimposed. Vp-p=1,000 V and (f)=0.2 Hz and the other conditions were the same as in experiment with only (h) varied, The results are show in Table 22.

TABLE 22

| example | 5 | 6 | 7 |
|---|---|---|---|
| h (mm) | 0.5 | 1.0 | 1.3 |
| Bo (G) | 200 | 1000 | 1200 |
| M | 32 | 10 | 8 |
| V (mm/s) | 100 | 150 | 150 |
| image density | 1.38 | 1.33 | 1.31 |
| absence of fogging | good | good | good |
| absence of spreadness of toner | good | good | good |
| uniformity of width of thin lines | good | good | good |

Table 22 show that all of experiments 5 to 7 produce good results in terms of the image density, the fogging density ,the amount of spreadness of toner and the uniformity of the width of thin lines but that (h) is preferably as small as possible so as to obtain denser images.

Embodiment 4-2

Unlike Empodiment 4-1. the development gap Ds was set to 0, that is, contact development was performed to examine the influence of this invention.

The sleeveless roll magnet 41 used in this embodiment was a conductive roll magnet (volume resistivity: $5\times10^3$ Ω.cm) whose surface hardness(Hs 42) is smaller than the hardness of the surface of the photosensitive. This roll magnet comprised an elastic layer 20 mm in outer diameter formed on a copper shaft 6 mm in outer diameter, To prepare an elastic layer 20, a material mainly comprising 100 pts.wt.

of urethane rubber, 400 pts.wt. of Sr ferrite, and 100 pts.wt. of carbon black was kneaded, then mold, and vulcanized. The material was then polished, and 32 magnet poles were symmetrically located so that the surface magnetic flux density of the roll magnet would be 250 G. The image forming device and its use and the developer used in this embodiment are all the same as those in Embodiment 4-1 unless otherwise specified. Images were evaluated under the above conditions and the results are shown in Table 23.

TABLE 23

| | example | 8 | 9 | 10 | 11 |
|---|---|---|---|---|---|
| AC bias voltage | Vp-p (v) | — | 200 | 500 | 1000 |
| | f (KHz) | — | 1 | 0.1 | 0.5 |
| evaluation of image | image density | 1.35 | 1.38 | 1.40 | 1.45 |
| | fogging density | good | good | good | good |
| | absence of spreadness of toner | good | good | good | good |
| | uniformity of width of thin lines | good | good | good | good |

Table 23 shows that application of an AC bias voltage increases the image density and that the density increases with the voltage of an applied AC bias voltage, as in experiment 1 of Embodiment 4-1 in which non-contact development was performed.

The image density in Table 3 is relatively higher than that in table 1, and both Tables 3 and 1 produce good results in terms of the fogging density fogging, the amount of spreadness of toner, and the uniformity of thin lines. It was thus found that superimposition of an AC bias voltage on a DC bias voltage using the image forming method in accordance with this invention provides a higher image density than in noncontact development without deteriorating image quality even in contact development using a single-component developer.

The fourth invention uses a single-component developer to effectively eliminate the disadvantage of the prior aft involved in the use of a sleeveless roll magnet wherein a sufficient amount of charge is not supplied to the toner, while effectively preventing the fogging that may occur when a DC bias voltage is applied to a conventional conductive roll magnet for development. This serves to promote the reduction of the cost and size of image formation devices such as copying machines, facsimile terminal equipment, and printers using a sleeveless roll magnet that can be miniaturized.

What is claimed is:

1. An image forming method for conveying a magnetic developer held directly on the surface of a developer conveying member opposed to an image-bearing member to a developing region to visualize an electrostatic latent image, comprising:

implementing as said developer conveying member a semiconductive or insulating cylindrical magnet having a plurality of heteropolar magnet poles arranged alternatively on its surface, the overall magnet being integrally formed;

supplying said magnetic developer onto said surface of the cylindrical magnet, said developer containing a magnetic carrier and a toner;

rotating said developer conveying member to thereby convey the magnetic developer on the surface of the cylindrical magnet to the developing region; and attaching toner in the magnetic developer conveyed to the developing region to an electrostatic latent image formed on said image bearing member.

2. The image forming method according to claim 1 wherein said magnetic carrier has an average particle size of 10 to 150 μm and a magnetization of 50 emu/g or more in a magnetic field of 1,000 Oe, and the toner is magnetic and the magnetic developer has a toner concentration of 10 to 90 wt. %.

3. The image forming method according to claim 1 wherein said magnetic carrier has an average particle size of 5 to 100 μm and a magnetization of 50 emu/g or more in a magnetic field of 1,000 Oe, and the toner is non-magnetic and the magnetic developer has a toner concentration of 5 to 60 wt. %.

4. The image forming method according to claim 1 wherein, if the peripheral speed of said image bearing member, and the outer diameter, the number of magnetic poles, and the peripheral speed of said developer conveying member are represented as Vp (mm/s), D (mm), N, and Vm (mm/s), respectively, h (mm) that can be expressed as $\pi D.Vp/M.Vm$ has a value of 2 or less, and said developer conveying member has a magnetic flux density (Bo) of 50 to 1,200 G on its surface.

5. The image forming method according to claim 1 wherein a regulating member for regulating the thickness of the developer layer is provided in said developer conveying member, and a developing bias voltage that is a superimposition of an AC bias voltage on a DC voltage is applied to this regulating member.

6. An image forming method for conveying a magnetic developer held directly on the surface of a developer conveying member opposed to an image-bearing member to a developing region to visualize an electrostatic latent image, comprising:

implementing as said developer conveying member a cylindrical magnet having a plurality of heteropolar magnetic poles located alternatively on its surface and having a volume resistivity of $10^6$ Ω.cm at least on its surface, the overall magnet being integrally formed;

supplying said magnetic developer onto said surface of the cylindrical magnet, said developer containing a magnetic carrier and a toner;

applying to said developing region a developing bias voltage that is a superimposition of an AC bias voltage on a DC bias voltage; and rotating said developer conveying member to thereby convey the magnetic developer on the surface of the cylindrical magnet to the developing region, where the toner in the developer is attached to an electrostatic latent image formed on the surface of said image-bearing member.

7. The image forming method according to claim 6 wherein said magnetic carrier has an average particle size of 10 to 100 μm as well as a non-spherical form, and the toner is magnetic and the developer has a toner concentration of 10 to 90 wt. %.

8. The image forming method according to claim 6 wherein said magnetic carrier has an average particle size of 10 to 100 μm as well as a non-spherical form, and the toner is non-magnetic and the developer has a toner concentration of 5 to 60 wt. %.

9. The image forming method according to claim 6 wherein, if the peripheral speed of said image-bearing member, and the outer diameter, the number of magnetic poles, and the peripheral speed of said developer conveying member are represented as Vp (mm/s), D (mm), M, and Vm (mm/s), respectively, h (mm) that can be expressed as $\pi D.Vp/M.Vm$ has a value of 2 or less, and said developer conveying member has a magnetic flux density (Bo) of 50 to 1,200 G on its surface.

10. The image forming method according to claim 6 wherein a regulating member for regulating the thickness of the developer layer is provided in said developer conveying member, and a developing bias voltage that is a superimposition of an AC bias voltage on said DC bias voltage is applied to this regulating member.

11. An image forming method for conveying a magnetic developer held directly on the surface of a developer conveying member opposed to an image-bearing member to a developing region to visualize an electrostatic latent image, comprising:

implementing as said developer conveying member a semiconductive or insulating cylindrical magnetic having a plurality of heteropolar magnetic poles located alternatively on its surface, the overall magnet being integrally formed;

supplying a layer of said magnetic developer onto said surface of the cylindrical magnet, said developer containing an insulating toner;

setting the gap between the image-bearing member and the developer conveying member so that it is larger than a thickness of the layer of said magnetic developer;

applying to said developing region a developing bias voltage that is the superimposition of an AC bias voltage on a DC bias voltage; and rotating said developer conveying member to thereby convey the magnetic developer on the surface of the cylindrical magnet to the developing region, where the developer is attached to an electrostatic latent image formed on the surface of said image bearing member.

12. The image forming method according to claim 11 wherein said magnetic developer is a two-component developer comprising a carrier having an average particle size of 10 to 150 μm and a magnetization of 50 emu/g or more in a magnetic field of 1,000 Oe and magnetic toner, the developer having a toner concentration of 10 to 90 wt. %.

13. The image forming method according to claim 11 wherein said magnetic developer is a two-component developer comprising having an average particle size of 10 to 150 μm and a magnetization of 50 emu/g or more in a magnetic field of 1,000 Oe and a non-magnetic toner,the developer having a toner concentration of 5 to 60 wt. %.

14. The image forming method according to claim 11 wherein said magnetic developer is a single-component developer comprising a magnetic toner.

15. The image forming method according to claim 11 wherein, if the peripheral speed of said image bearing member, and the outer diameter, the number of magnetic poles, and the peripheral speed of said developer transfer component are represented as Vp (mm/s), D (mm), M, and Vm (mm/s), respectively, h (mm) that can be expressed as $\pi D.Vp/M.Vm$ has a value of 2 or less, and said developer conveying member has a magnetic flux density (Bo) of 50 to 1,200 G on its surface.

16. An image forming method for conveying a magnetic developer held directly on the surface of a developer conveying member opposed to an image-bearing member to a developing region to develop an electrostatic latent image, comprising:

regulating the thickness of a toner layer on said developer conveying member with a regulating member;

implementing as said developer conveying member a cylindrical magnet with a plurality of heteropolar magnetic poles located alternatively on its surface, the overall magnet being integrally formed;

supplying said magnetic developer onto said surface of the cylindrical magnet, said developer comprising a single-component developer containing a magnetic toner;

applying to said developing region a developing bias that is a superimposition of an AC bias voltage on a DC bias voltage; and rotating said developer conveying member to thereby convey the magnetic developer to the developing region, where the magnetic toner is attached to an electrostatic latent image formed on the surface of said image-bearing member.

17. The image forming method according to claim 16 wherein, if the peripheral speed of said image-bearing member, and the outer diameter, the number of magnetic poles, and the peripheral speed of said developer conveying member are represented as Vp (mm/s), D (mm), M, and Vm (mm/s), respectively, h (mm) that can be expressed as $\pi D.Vp/M.Vm$ has a value of 2 or less, and said developer conveying member has a magnetic flux density (Bo) of 50 to 1,200 G on its surface.

* * * * *

UNITED STATES PATENT AND TRADEMARK OFFICE

CERTIFICATE OF CORRECTION

PATENT NO. : 5,554,479

DATED : September 10, 1996

INVENTOR(S) : Ochiai et al.

It is certified that error appears in the above-indentified patent and that said Letters Patent is hereby corrected as shown below:

Column 4, line 29, delete "$\pi$D.Vp/M.Vm" and substitute --$\pi$D·Vp/M·Vm--;
line 63, delete "$10^6\Omega$.cm" and substitute --$10^6\Omega$·cm--.

Column 5, line 19, delete "$\pi$D.Vp/M.Vm" and substitute --$\pi$D·Vp/M·Vm--;
line 32, delete "$10^6\Omega$.cm" and substitute --$10^6\Omega$·cm--;
line 36, delete "$10^6\Omega$.cm" and substitute --$10^6\Omega$·cm--;
line 48, after "to", insert --a--.

Column 6, line 8, after "emu/g", insert --or more in--;
line 23, delete "$\pi$D.Vp/M.Vm" and substitute --$\pi$D·Vp/M·Vm--;
line 53, delete "$\pi$D.Vp/M.Vm" and substitute --$\pi$D·Vp/M·Vm--.

Column 8, line 40, delete "Vm"; after "and", insert --Vm--;
line 41, after "D,", insert --M,--;
line 45, delete "h=$\pi$D.Vp/M.Vm(mm)" and substitute --h=$\pi$D·Vp/M·Vm(mm)--;
line 58, delete "+P" and insert new paragraph indention;
line 66, delete "+P" and insert new paragraph indention.

UNITED STATES PATENT AND TRADEMARK OFFICE

CERTIFICATE OF CORRECTION

PATENT NO. : 5,554,479

DATED : September 10, 1996

INVENTOR(S) : Ochiai et al.

It is certified that error appears in the above-indentified patent and that said Letters Patent is hereby corrected as shown below:

Column 9, line 7, delete "+P" and insert new paragraph indention;
line 13, delete "+P" and insert new paragraph indention;
line 16, delete "+P" and insert new paragraph indention;
line 20, delete "+P" and insert new paragraph indention;
line 26, delete "+P" and insert new paragraph indention;
line 33, delete "+P" and insert new paragraph indention;
line 38, delete "+P" and insert new paragraph indention;
line 40, delete "+P" and insert new paragraph indention;
line 43, after "for", insert --a--;
line 49, delete "+P" and insert new paragraph indention;
line 55, delete "+P" and insert new paragraph indention;
line 64, delete "+P" and insert new paragraph indention;
line 66, delete "$10^{14}\Omega$.cm" and substitute --$10^{14}\Omega\cdot$cm--.

Column 10, line 4, delete "+P" and insert new paragraph indention;
line 10, delete "+P" and insert new paragraph indention;

UNITED STATES PATENT AND TRADEMARK OFFICE

CERTIFICATE OF CORRECTION

PATENT NO. : 5,554,479

DATED : September 10, 1996

INVENTOR(S) : Ochiai et al.

It is certified that error appears in the above-indentified patent and that said Letters Patent is hereby corrected as shown below:

line 18, delete "+P" and insert new paragraph indention;
line 20, delete "+P" and insert new paragraph indention;
line 25, delete "+P" and insert new paragraph indention;
line 29, delete "." (first occurrence);
line 56, after "resin", insert --40--;
line 67, delete "Ω.cm" and substitute --Ω·cm--.

Column 12, line 48, after "by", insert --Mitsubishi Kasei Kogyo K.K.), 3 pts. wt.--
line 53, delete "Ω.cm" and substitute --Ω·cm--

Column 17, line 66, delete "Ω.cm" and substitute --Ω·cm--;
line 67, delete "$10^4$Ω.cm" and substitute --$10^4$Ω·cm--.

Column 18, line 22, delete "h=πD.Vp/M.Vm(mm)" and substitute --h=πD·Vp/M·Vm(mm)--.

Column 19, line 22, delete "$10^{14}$Ω.cm" and substitute --$10^{14}$Ω·cm--.

Column 24, line 47, delete "h=πD.Vp/M.Vm" and substitute --h=πD·Vp/M·Vm--.

UNITED STATES PATENT AND TRADEMARK OFFICE

CERTIFICATE OF CORRECTION

PATENT NO. : 5,554,479

DATED : September 10, 1996

INVENTOR(S) : Ochiai et al.

It is certified that error appears in the above-indentified patent and that said Letters Patent is hereby corrected as shown below:

Column 25, line 52, delete "9m" and substitute --9μm--;
line 53, delete "Ω.cm" and substitute --Ω·cm--.

Column 26, line 30, delete "Ω.cm" and substitute --Ω·cm--;
line 55, delete "Ω.cm" and substitute --Ω·cm--.

Column 28, line 56, delete "h=πD.Vp/M.Vm(mm)" and substitute --h=πD·Vp/M·Vm(mm)--.

Column 29, line 21, delete "Ω.cm" and substitute --Ω·cm--;
line 48, delete "Ω.cm" and substitute --Ω·cm--.

Column 30, line 63, delete "Ω.cm" and substitute --Ω·cm--

Column 32, line 16, delete "N" and substitute --M--;
line 18, delete "πD.Vp/M.Vm" and substitute --πD·Vp/M·Vm--;
line 34, delete "$10^6$Ω.cm" and substitute --$10^6$Ω·cm--;
line 65, delete "πD.Vp/M.Vm" and substitute --πD·Vp/M·Vm-.

Column 34, line 7, delete "πD.Vp/M.Vm" and substitute --πD·Vp/M·Vm-;.

UNITED STATES PATENT AND TRADEMARK OFFICE

CERTIFICATE OF CORRECTION

PATENT NO. : 5,554,479

DATED : September 10, 1996

INVENTOR(S) : Ochiai et al.

It is certified that error appears in the above-indentified patent and that said Letters Patent is hereby corrected as shown below:

Column 34, line 43, delete "$\pi$D.Vp/M.Vm" and substitute --$\pi$D·Vp/M·Vm-.

Signed and Sealed this

Thirty-first Day of December, 1996

Bruce Lehman

*Attest:*

BRUCE LEHMAN

*Attesting Officer*

*Commissioner of Patents and Trademarks*